US011486221B2

(12) United States Patent
Hart

(10) Patent No.: US 11,486,221 B2
(45) Date of Patent: Nov. 1, 2022

(54) WELLBORE CASING REPAIR SAFETY TOOL FOR LOW-PRESSURE HYDROCARBON WELLS

(71) Applicant: David Hart, Dallas, TX (US)

(72) Inventor: David Hart, Dallas, TX (US)

(73) Assignee: David Hart, Dallas, TX (US)

( * ) Notice: Subject to any disclaimer, the term of this patent is extended or adjusted under 35 U.S.C. 154(b) by 0 days.

(21) Appl. No.: 17/148,292

(22) Filed: Jan. 13, 2021

(65) Prior Publication Data

US 2021/0131218 A1 May 6, 2021

Related U.S. Application Data

(63) Continuation of application No. 15/436,350, filed on Feb. 17, 2017, now abandoned.

(51) Int. Cl.

| | |
|---|---|
| ***E21B 33/12*** | (2006.01) |
| ***E21B 41/00*** | (2006.01) |
| ***E21B 33/126*** | (2006.01) |

(52) U.S. Cl.

CPC ..... *E21B 33/12* (2013.01); *E21B 33/126* (2013.01); *E21B 41/0021* (2013.01)

(58) Field of Classification Search

CPC ..... E21B 33/12; E21B 33/124; E21B 33/126; E21B 41/0021; E21B 33/08

See application file for complete search history.

(56) References Cited

U.S. PATENT DOCUMENTS

| | | | | |
|---|---|---|---|---|
| 977,402 | A | 11/1910 | Rohmer | |
| 2,129,439 | A | 9/1938 | Noble | |
| 2,275,190 | A | 3/1942 | Lowry | |
| 3,766,587 | A | 10/1973 | French | |
| 3,899,631 | A * | 8/1975 | Clark | E21B 17/003 166/187 |
| 4,287,948 | A | 9/1981 | Haggard | |
| 4,424,865 | A | 1/1984 | Payton, Jr. | |
| 4,930,223 | A | 6/1990 | Smith | |
| 5,597,505 | A | 1/1997 | Koenig et al. | |

(Continued)

FOREIGN PATENT DOCUMENTS

| | | |
|---|---|---|
| CA | 2156779 A | 2/1997 |
| WO | WO 2016/0153521 | 9/2016 |

OTHER PUBLICATIONS

"Interference. (n.d.)," American Heritage® Dictionary of the English Language, Fifth Edition, (2011), Retrieved Jan. 7, 2020, from https://www.thefreedictionary.com/interference (Year: 2011).

(Continued)

*Primary Examiner* — Robert E Fuller
*Assistant Examiner* — Theodore N Yao
(74) *Attorney, Agent, or Firm* — Fish & Richardson P.C.

(57) ABSTRACT

A wellbore tool includes a rod with a plurality of rod sections. The rod is configured to be placed within a wellbore casing of a low-pressure hydrocarbon well. A plurality of sealing elements are positioned at a downhole end of the rod. Each sealing element is configured to provide a gas-tight seal between the sealing element and an inner wall of the wellbore casing. A handle positioned at an uphole end of the rod provides a hand grip for a user of the wellbore tool.

9 Claims, 13 Drawing Sheets

(56) References Cited

U.S. PATENT DOCUMENTS

| | | | | |
|---|---|---|---|---|
| 6,173,788 | B1 * | 1/2001 | Lembcke | E21B 33/128 166/387 |
| 6,368,418 | B1 | 4/2002 | Rowe | |
| 7,264,061 | B2 * | 9/2007 | Dybevik | E21B 17/026 166/385 |
| 7,762,322 | B2 * | 7/2010 | Andersen | E21B 17/023 166/387 |
| 2002/0112858 | A1 * | 8/2002 | McDaniel | E21B 17/012 166/350 |
| 2007/0118980 | A1 | 5/2007 | Johnson et al. | |
| 2009/0242191 | A1 | 10/2009 | Wildman et al. | |
| 2009/0250228 | A1 * | 10/2009 | Loretz | E21B 33/12 166/387 |
| 2009/0283254 | A1 * | 11/2009 | Andersen | E21B 17/023 166/387 |
| 2010/0101066 | A1 | 4/2010 | Stein et al. | |
| 2010/0289224 | A1 | 11/2010 | Savard et al. | |
| 2011/0277255 | A1 | 11/2011 | Harper | |
| 2012/0298359 | A1 | 11/2012 | Eden | |
| 2014/0131953 | A1 | 5/2014 | Lehr | |
| 2015/0267501 | A1 | 9/2015 | Al-Gouhi | |
| 2016/0002907 | A1 | 1/2016 | Santo | |
| 2018/0207693 | A1 | 7/2018 | Long | |
| 2018/0347305 | A1 * | 12/2018 | Angers, Jr. | E21B 33/068 |
| 2018/0363996 | A1 | 12/2018 | Hooper et al. | |

OTHER PUBLICATIONS

Notification of Transmittal of the International Search Report and Written Opinion in related PCT appln No. PCT/US2018/00060; dated May 14, 2018; 20 pages.

* cited by examiner

WELLBORE CASING REPAIR SAFETY TOOL FOR LOW-PRESSURE HYDROCARBON WELLS

CLAIM OF PRIORITY

This application is a continuation of and claims the benefit of priority under 35 USC § 120 to WIPO Application Serial No. PCT/US2018/000060, filed on Feb. 16, 2018; now published as WO 2018/151845 on Aug. 23, 2018; entitled: "WELLBORE CASING REPAIR SAFETY TOOL FOR LOW-PRESSURE HYDROCARBON WELLS"; which claims the benefit of priority under 35 USC § 120 and to U.S. patent application Ser. No. 15/436,350, filed on Feb. 17, 2017; entitled: "WELLBORE CASING REPAIR SAFETY TOOL FOR LOW-PRESSURE HYDROCARBON WELLS"; the entire contents of each and both are hereby incorporated by reference.

BACKGROUND

In hydrocarbon production, a wellbore is drilled into a hydrocarbon bearing geologic formation. The wellbore is completed and, in some instances, lined with a wellbore casing to complete a hydrocarbon well (for example, a low-pressure production or injection well). As the hydrocarbon well ages, the wellbore casing can begin to degrade and require repair.

SUMMARY

The present disclosure describes a casing welding safety tool for low-pressure hydrocarbon wells.

In an implementation, a wellbore tool includes a rod with a plurality of rod sections. The rod is configured to be placed within a wellbore casing of a low-pressure hydrocarbon well. A plurality of sealing elements are positioned at a downhole end of the rod. Each sealing element is configured to provide a gas-tight seal between the sealing element and an inner wall of the wellbore casing. A handle positioned at an uphole end of the rod provides a hand grip for a user of the wellbore tool.

Some functions or operations associated with described implementations are implementable using a computer-implemented method; a non-transitory, computer-readable medium storing computer-readable instructions to perform the computer-implemented method; and a computer-implemented system comprising a computer memory interoperably coupled with a hardware processor configured to perform the computer-implemented method/the instructions stored on the non-transitory, computer-readable medium.

The subject matter described in this specification can be implemented in particular implementations so as to realize one or more of the following advantages. First, described implementations of a wellbore tool permit safe repair of damaged wellbore casing of a low-pressure hydrocarbon well. The described wellbore tool isolates potentially toxic or flammable/combustible downhole gases/fluids from an uphole atmosphere. This isolation is necessary for personal safety as sparks or open flame produced or used in wellbore casing repair (for example, produced in cutting or welding) can cause a hazardous situation if present during repair operations. Second, the described wellbore tool is inexpensive to manufacture, easy to assemble/disassemble in the field, can be quickly installed into/removed from a wellbore casing, and is easily transportable/storable. Third, the described wellbore tool can be easily configured to fit different diameters of wellbore casing. Fourth, sealing elements used in the described wellbore tool are user replaceable to permit routine/easy maintenance. Fifth, the described wellbore tool can be configured with various sensors for analysis of data related to a particular wellbore casing/hydrocarbon well (for example, temperature, pressure, chemical analysis, and the like). Other advantages will be apparent to those of ordinary skill in the art.

The details of one or more implementations of the subject matter of this specification are set forth in the accompanying drawings and the description. Other features, aspects, and advantages of the subject matter will become apparent from the description, the drawings, and the claims.

DESCRIPTION OF DRAWINGS

Like reference numbers and designations in the various drawings indicate like elements.

DETAILED DESCRIPTION

Figure 1:
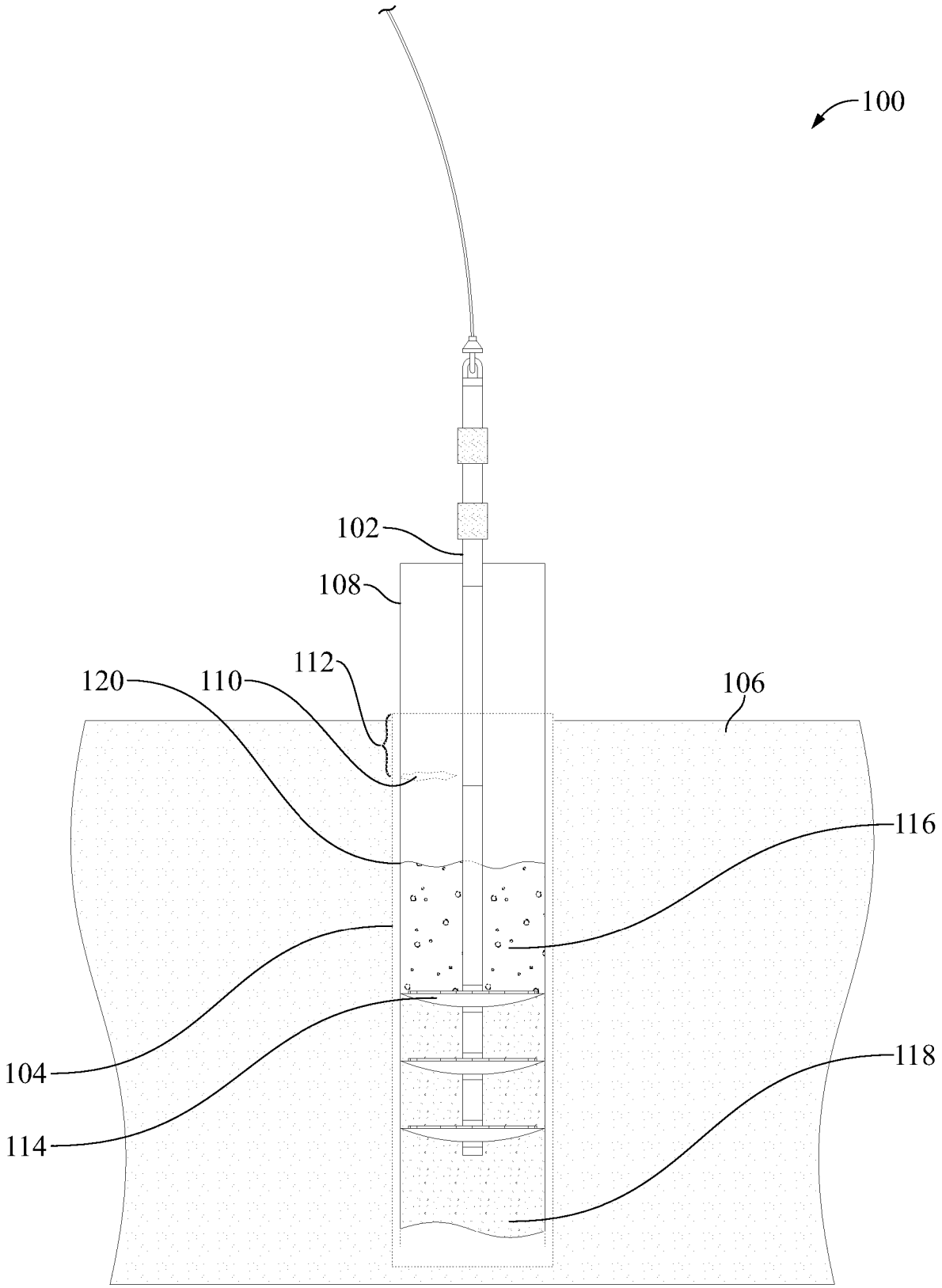
FIG. 1 is an illustration of a first implementation of a wellbore tool installed in a low-pressure wellbore of a hydrocarbon well, according to an implementation.

The following detailed description describes a wellbore tool and is presented to enable any person skilled in the art to make and use the disclosed subject matter in the context of one or more particular implementations. Various modifications to the disclosed implementations will be readily apparent to those of ordinary skill in the art, and described principles may be applied to other implementations and applications without departing from scope of the disclosure. Accordingly, the present disclosure is not intended to be limited to the described or illustrated implementations, but is to be accorded the widest scope consistent with the principles and features disclosed herein.

In hydrocarbon production, a wellbore is drilled into a hydrocarbon bearing geologic formation. The wellbore is completed and, in some instances, lined with a wellbore casing to complete a hydrocarbon well (for example, a low-pressure production or injection well). As the hydrocarbon well ages, the wellbore casing can begin to degrade and require repair.

Such degradation can be caused, for example, by excess hydrogen sulfide (H2S), carbon dioxide (CO2), various precipitated salts, water, or any combination of these substances found in a fluid stream flowing through the wellbore casing or in the earth surrounding the wellbore casing. Other causes of degradation to the wellbore casing can include erosion from particulates in the flow path, galvanic corrosion, or any other cause of material loss. Additional damage can also occur due to contact with various materials in the earth (for example, caliche clay), ground shift, physical impact to the wellbore casing, and the like. When a wellbore casing wall thickness of a section of wellbore casing drops below a certain minimum thickness or loses structural integrity, that section of wellbore casing is often replaced.

To replace a wellbore casing section, the well itself must be sealed so that no toxic or flammable/combustible gases/fluids are present at the section of wellbore casing being repaired (for example, by actions including cutting and welding the wellbore casing). The isolation is necessary for personal safety as sparks or open flame produced or used in wellbore casing repair can cause a hazardous situation if any toxic or flammable/combustible gases/fluids are present.

Production packers (hereinafter "packers") are sometimes used to seal the wellbore or the outside of production tubing and the inside of the wellbore casing from the damaged wellbore casing section. Typically a non-flammable/non-combustible fluid (for example, water) is added above the production packer to help prevent escape of toxic or flammable/combustible gases/fluids from the wellbore. However, the use of packers for older or low-yield low-pressure hydrocarbon wells is often prohibitively expensive. For example, packers often require heavy/bulky lifting equipment and hydraulic power units to place them into a wellbore. Packers can also require a prohibitive amount of time (for example, days) to install and remove properly and can be difficult to set into place, taking multiple attempts to achieve a satisfactory/reliable wellbore seal. Packers are also designed to handle a large pressure differential once installed, and the use of packers on older or low-yield low-pressure hydrocarbon wells often makes little financial sense given their overall cost and difficulty of use.

This disclosure describes a novel wellbore tool for sealing a low-pressure wellbore casing. The wellbore tool can be installed into a wellbore casing of a low-pressure hydrocarbon well without the need for heavy/bulky heavy lifting equipment. The wellbore tool can also be easily assembled for use and disassembled/configured for ease of storage/transport. The wellbore tool includes multiple sealing elements on a downhole end of a rod. For purposes of this disclosure, "uphole" means in a direction toward the surface of the earth, while "downhole" means in a direction into the earth. The uphole end of the rod includes ergonomic grips forming a handle to ease handling of the wellbore tool for a user.

FIG. 1 is an illustration 100 of a first implementation of a wellbore tool installed in a casing lining a low-pressure wellbore of a hydrocarbon well, according to an implementation. The wellbore tool 102 is inserted into a low-pressure wellbore 104 casing (illustrated with dashed lines) within the earth 106. In typical implementations, the wellbore tool 102 is approximately 20.0 feet in length and used in cased wellbores 6.0 inches in diameter or smaller (for example, 4.5 inches to 5.5 inches), however a longer or shorter wellbore tool 102 or use in larger or smaller diameter wellbore casings is considered to be within the scope of this disclosure.

In the implementations discussed within this disclosure, a low-pressure hydrocarbon well typically has a pressure less than or equal to 25.0 pounds per square inch gauge. Low-pressure wellbore 104 can be either a production well or an injection well. As will be understood by those of ordinary skill in the art, and consistent with the principles described herein, the described implementation could be modified to be used in higher pressure applications.

In this illustration an uphole portion of a wellbore casing 108 within the low-pressure wellbore 104 is damaged at 110 (for example, a hole, crack, or leak due to previously-described corrosion/material loss or other type of damage). In typical situations, damage to the wellbore casing 108 occurs at from the top of the wellbore casing 108 to approximately 5.0 feet beneath the surface of the earth 106. As such, the earth 106 around the wellbore casing 108 must be excavated to allow access to damaged portion 110.

In some instances, wellbore casing portion 112 can be cut off at or slightly below the damaged portion 110 (for example, a few inches) as long as structurally sound wellbore casing 108 is left to effect a repair to the wellbore casing 108). In other instances, the damaged portion 110 can be patched (for example, with a welded patch or collar of wellbore casing 108 or other material) and without the need to cut and remove an entire section of wellbore casing 108. To permit repair of the wellbore casing 108 (either by replacement or patching), the wellbore casing 108 must be sealed below the damaged portion 110 to prevent toxic or flammable/combustible gases/fluids from being present during repair operations of the wellbore casing 108.

As illustrated, the wellbore tool 102 is inserted into the wellbore casing 108 so that the upper (furthest uphole) sealing element 114 configured as part of the wellbore tool 102 is downhole of the damaged portion 110. Typically, the wellbore tool 102 can be inserted into the wellbore casing 108 by human intervention only and pushed by down into the wellbore casing 108 to a desired depth to at least partially seal the wellbore casing 108 below the damaged portion 108 with a hermetic-type seal. Bulky/heavy machinery is not necessary to insert, position, or remove the wellbore tool 102 into, within, or from, respectively, the wellbore casing 108.

Once the wellbore tool 102 is positioned in the wellbore casing 108, a static column of a non-flammable/non-combustible fluid 116 (for example, water) is inserted into the wellbore casing 108 to a level uphole from the upper sealing element 114 but downhole from the damaged portion 110. The non-flammable/non-combustible fluid 116 may also flow to fill the spaces between the upper sealing element 114 and one or more additional sealing elements downhole from the upper sealing element 114 to provide additional sealing of the wellbore casing 108 if necessary. The addition of the non-flammable/non-combustible fluid 116 provides additional hermetic-type sealing of the wellbore casing 108 to isolate any potential toxic or flammable/combustible gas/fluid 118 produced within the wellbore casing 108 from migrating upward toward the uphole-end of the wellbore casing 108 proximate to the damaged portion 110. The fluid level 120 is typically the top of a 10.0 ft. column of non-flammable/non-combustible fluid 116 and situated approximately 3.0 ft. below the damaged portion 110. A 10.0 ft. column of non-flammable/non-combustible fluid 116 should be sufficient to provide an adequate static head for sealing of the lower wellbore casing 108 from the uphole portion of the wellbore casing 108 and to provide enough fluid volume to absorb heat from any sparks or open-flame from cutting, welding, or other operations during repair of the wellbore casing.

Once repairs are completed to the wellbore casing 108, the wellbore tool 102 can be pulled from the wellbore casing 108 either by hand or with the assistance of a winch or similar device if necessary. The wellbore tool 102 can then be configured for storage or movement to another location for use.

Figure 2:
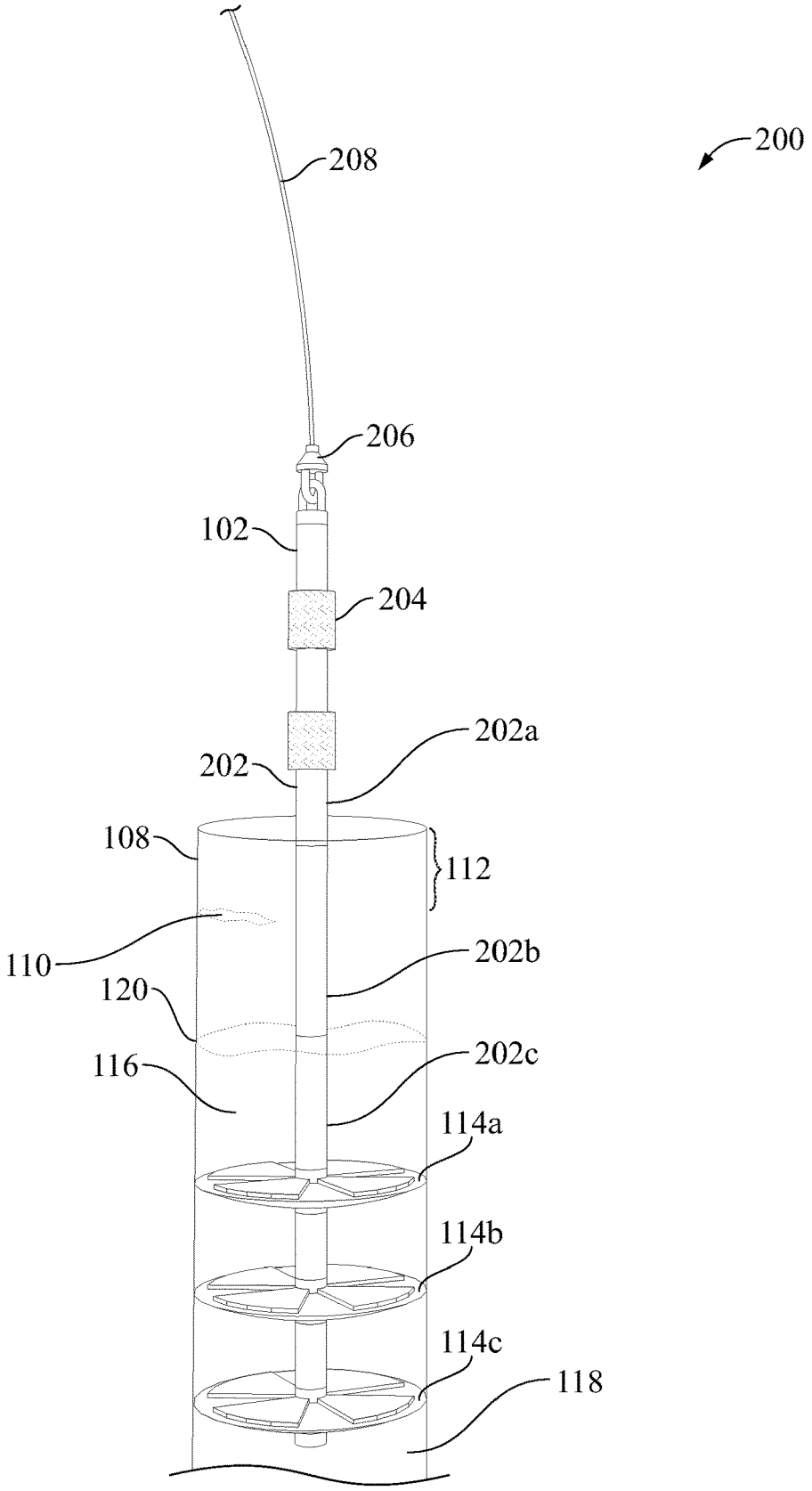
FIG. 2 is detailed view of the wellbore tool of FIG. 1 within a wellbore casing, according to an implementation.

FIG. 2 is detailed view of the wellbore tool of FIG. 1 within a wellbore casing, according to an implementation. As illustrated, wellbore tool 102 is positioned within wellbore casing 108 and a non-flammable/non-combustible fluid 116 has been added to the wellbore casing 108 to fluid level 120.

The wellbore tool 102 includes a rod 202 supporting one or more sealing elements 114 (here illustrated as sealing elements 114*a*, 114*b*, and 114*c*) and of sufficient length to position the one or more sealing elements 114 into the wellbore casing 108 at a desired depth below a damaged portion of the wellbore casing (for example damaged portion 110 of FIG. 2). The rod 202 can be made of any material that has sufficient strength to support the insertion and removal of the wellbore tool 102 into and out of the wellbore casing 108. For example, materials can include metal, plastic, fiberglass, carbon fiber, composite, or any other material. In some implementations, the rod 202 (or separate rod segments) can be configured as solid, hollow, or a combination of solid and hollow. For example, the rod 202 (or separate rod segments) can be configured with an open/hollow core permitting wires, cables, or fiber to be run through the rod 202 (or separate rod segments).

In some implementations (not illustrated), the rod 202 can be a single, solid, non-segmented rod. For example, in a particular implementation, this configuration of rod 202 can be approximately 1.0-2.0 inches in diameter and 18.0 feet in length and threaded at least at the downhole end for attachment of the one or more sealing elements 114.

In other implementations, the rod 202 can be a rod string of multiple rod segments (for example, but not limited to, three) of equal or varying length (for example, each rod segment configured to be approximately 1.0-2.0 inches in diameter and 6.0 feet in length). In some configurations, one or more of the multiple rod segments can vary in diameter or length depending upon its particular use in the described wellbore tool 102. Each rod segment of the rod 202 (here illustrated as rod segments 202*a*, 202*b*, and 202*c*) can be threaded at each end to couple with another rod segment to form overall rod 202. For example, in one particular implementation, rod segment 202*a* can be female-threaded at the downhole end, while the uphole end of rod segment 202*b* can be male-threaded but female-threaded at the downhole end (rod segment 202*c* is typically configured in a manner similar to segment 202*b*). In the multiple rod segment configuration, some implementations permit attached rod segments to be "locked" into place in relation with each other through the use of pins (for example, cotter-type pins) or bolts/nuts inserted through holes defined in the shafts of one or more of rod segments 202*a*, 202*b*, and 202*c*, mechanical latch, or other locking mechanism apparent to those of ordinary skill in the art. In some implementations, each end (or other portion) of the rod segments 202*a*, 202*b*, and 202*c*) can be configured to define a flat surface on two opposite sides of the rod segment to allow a wrench (for example, a crescent or pipe wrench) to be used to tighten the screw-type attachment of adjacent rod segments.

In other implementations (not illustrated), the rod 202 can be a rod string configured of multiple telescoping rod segments (for example, rod segments 202*a*, 202*b*, and 202*c*) that permit rod 202 to be collapsed for easy transport or storage. For example, rod segments 202*a*, 202*b*, and 202*c* could be fully extended and locked into place forming rod 202 and the one or more sealing elements 114 attached to form the wellbore tool 102. In the telescopic configuration, the rod segments could be "locked" into place using a twist-type friction lock configuration, pins/bolts (as previously-described), mechanical latch, or other mechanical locking mechanism apparent to those of ordinary skill in the art. In some telescopic configurations, the rod segments 202*a*, 202*b*, and 202*c* can be fully separated, while in others, the rod segments 202*a*, 202*b*, and 202*c* are "captured" in relation to each other and not separable. In some implementations, each end (or other portion) of the rod segments 202*a*, 202*b*, and 202*c*) can be configured to define a flat surface on two opposite sides of the rod segment to allow a wrench (for example, a crescent or pipe wrench) to be used to twist adjacent rod segments in relation to each other (for example, in a twist-type friction lock configuration).

In still other implementations (not illustrated), rod segments 202*a*, 202*b*, and 202*c* can be configured at each end with male/female interlocking structures to permit the rod segments 202*a*, 202*b*, and 202*c* to be interlocked together. As previously-described, various mean can be used to lock the rod segments 202*a*, 202*b*, and 202*c* together during use (for example, the use of pins or bolts/nuts inserted through holes defined in the shafts of one or more of rod segments 202*a*, 202*b*, and 202*c*, or other locking mechanisms apparent to those of ordinary skill in the art).

In typical configurations, upper rod segment 202*a* is configured with ergonomic grips 204. Grips 204 are typically contoured and configured of a non-slip, elastomeric material (for example, rubber, silicon, or other pliant, resilient material), leather, or other material to permit one or more human hands to securely grasp the wellbore tool 102 and to impart a downhole force to push the wellbore tool 102 into the wellbore casing 108 or to pull the wellbore tool 102 from the wellbore casing 108. In some implementations, rubber grips 204 can also be configured on a lower (that is, downhole) portion of rod 202 (for example, one or more of rod segments 202*b* and 202*c*) to permit the wellbore tool 102 to be grasped on each rod segment while pushing or pulling the wellbore tool 102 into or out of the wellbore casing 108, respectively). In some implementations, the rubber grips 204 can be configured to be removable (for example, to permit the rod segments 202*a*, 202*b*, and 202*c* to telescope more fully with respect to each other).

In typical implementations, rod 202 (for example, rod segment 202*a*) is configured with an safety line attachment point 208 to permit a cable, rope, or other type of safety line 208 to be attached to the wellbore tool 102 to secure the wellbore tool 102 at a point external to the wellbore casing 108 (for example, to a vehicle, support frame or stake in the earth 106) or to a portion of the wellbore casing 108 itself to prevent the wellbore tool 102 from slipping down into the wellbore casing 108 and out-of-reach of the user. For example, the safety line attachment point 206 can be a ring or other structure that the safety line 208 can be attached. In some implementations, the uphole end of rod 202 (for example, rod segment 202*a*) can threaded or configured to accept and lock into place (for example, as previously described) differently-configured types of safety line attachment points for safety line 208.

Rod 202 is attached to one or more replaceable sealing elements 104 (again, illustrated as sealing elements 114*a*, 114*b*, and 114*c*). As illustrated, sealing elements 114*a*, 114*b*, and 114*c* are attached together in series at the downhole portion of rod 202. For example, sealing element 114*a* is attached to rod segment 202*c*, sealing element 114*b* is attached to sealing element 114*a*, and so on. Sealing elements can be configured to attach/lock to rod 202 and to each other using one or more of the previously-described configurations for connection/locking of rod segments 202*a*, 202*b*, and 202*c* (for example, configured with male/female threading to screw together and lock with pins or bolts).

In an implementation, sealing element 114 is configured as a hemispherical, compressible-type "cup" with the open end oriented in an uphole direction. In typical implementations, the sealing element is configured of an elastomeric-type material (for example, rubber, silicon, or other pliant, resilient material) providing an outward spring bias when compressed and capable of generating at least a substantially hermetic-type seal against the inner wall of the wellbore casing 108. Each sealing element 114 is also typically configured to be of a slightly larger diameter than the inner wall of the wellbore casing 108 to provide a tight fit/seal against the inner wall of the wellbore casing 108. Sealing elements 114 can be configured in different sizes to allow a user to choose an appropriate size depending upon the diameter of the wellbore casing 108 being worked with.

When inserted into to the wellbore casing 108, the orientation of the sealing element 114 generates an outward spring bias against the inner wall of the wellbore casing 108 to generate the substantially hermetic-type seal against upward-incursion of toxic or flammable/combustible gases/fluids toward the damaged portion (for example, damaged portion 110 of FIG. 1) of the wellbore casing 108 and generates friction between each sealing element and the inner wall of the wellbore casing 108 to mitigate downhole pressure in the wellbore casing 108 from pushing the wellbore tool 102 upward and out of the wellbore casing 108. In the described orientation, the sealing elements 114 also hold/retain the non-flammable/non-combustible fluid 116 from migrating downward into the wellbore casing 108. In typical implementations, more of the non-flammable/non-combustible fluid 116 will be present uphole from the sealing element 114*a* than between sealing elements 114*a* and 114*b* or 114*b* and 114*c*. In some implementations, a non-flammable/non-combustible fluid 116 can be added uphole from each sealing element 114 as the wellbore tool 102 is inserted into the wellbore casing 108.

Figure 3:
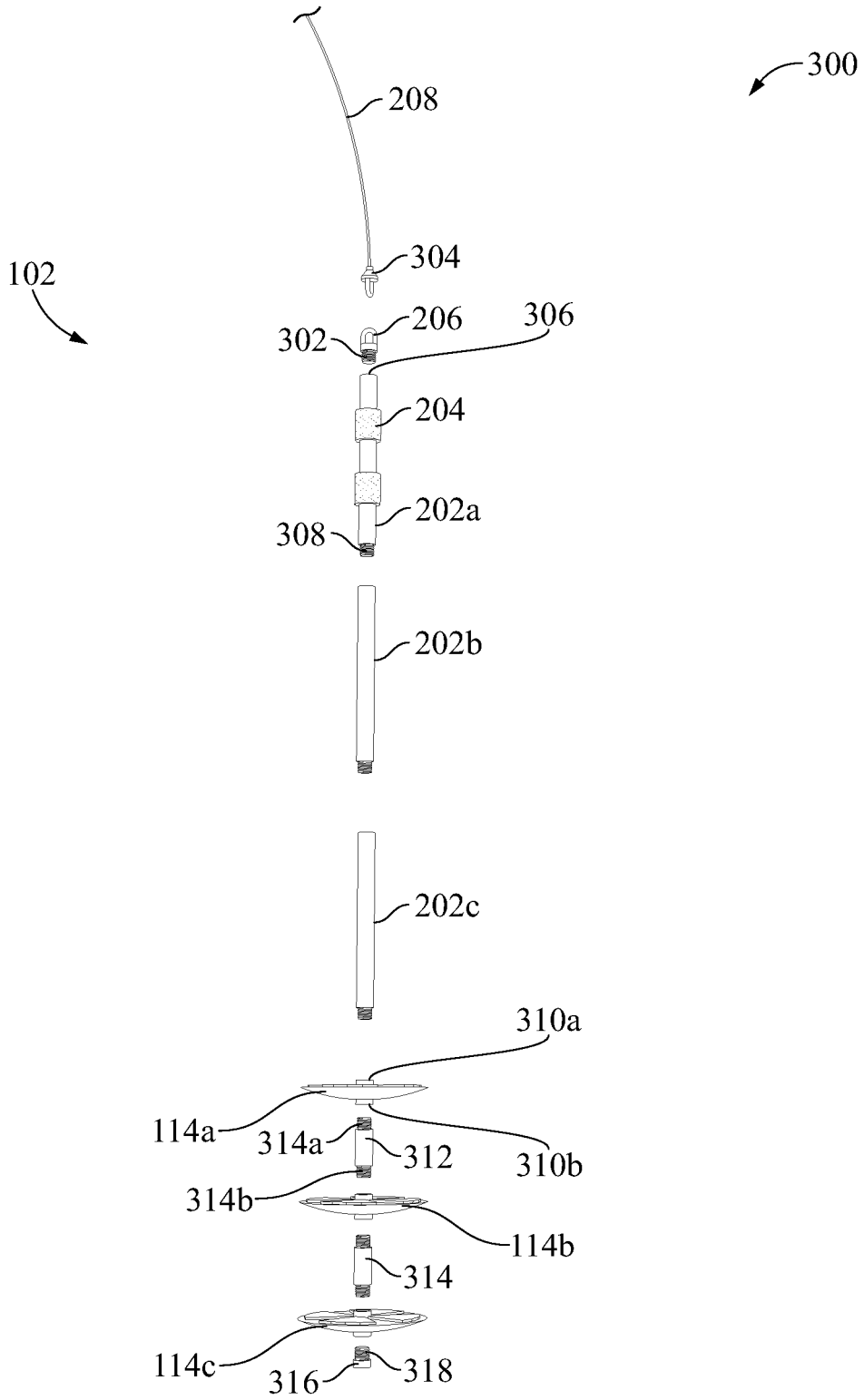
FIG. 3 is an exploded perspective view of the wellbore tool of FIGS. 1 and 2, according to an implementation.

FIG. 3 is an exploded perspective view 300 of the wellbore tool 102 of FIGS. 1 and 2, according to an implementation. As illustrated, wellbore tool 102 includes safety line attachment point 206, safety line 208, rod 202, and sealing elements 114.

Safety line attachment point 206 is illustrated as a ring-type structure for attachment of safety line 208. Safety line attachment point 206 is configured with a male threaded bolt 302 for attachment to female-threaded uphole attachment point 306 of rod segment 202*a* which receive male-threaded bolt 302. Safety line 208 includes a carabiner-type "clip" attached to safety line 208 and used to attach to safety line attachment point 206.

Rod 202 is configured as three threaded rod segments (rod segments 202*a*, 202*b*, and 202*c*). Each illustrated rod segment includes a female-threaded uphole attachment point 306 at the uphole end of the rod segment and a male-threaded attachment point 308 at the downhole end of the rod segment. Each rod segment 202*a*, 202*b*, and 202*c* screws into another rod segment to form rod 202. Rod segment 202*c* attaches to sealing element 114*a*.

Each sealing element 114 is configured with a female-threaded uphole attachment point 310*a* and female-threaded downhole attachment point 310*b*. Sealing elements (for example, sealing element 114*a* and 114*b*) are attached together using connecting rod 312. Illustrated connecting rods 312 are configured with a male-threaded uphole attachment point 314*a* and male-threaded downhole attachment point 314*b* for connecting to either female-threaded uphole attachment point 310*a* or female-threaded downhole attachment point 310*b*. The female-threaded downhole attachment point 310*b* of sealing element 114*c* is shown attached to a plug 316 with a male-threaded uphole attachment point 318. Plug 316 is used to seal the female-threaded downhole attachment point 310*b* from foreign material (for example, particulates or residue) downhole in wellbore casing 108. In other implementations, the sealing element 114 and connecting rod 312 can be configured with mechanical or other previously-described attachment mechanisms with respect to the rod 202 and rod segments 202*a*, 202*b*, and 202*c*.

Figure 4A:
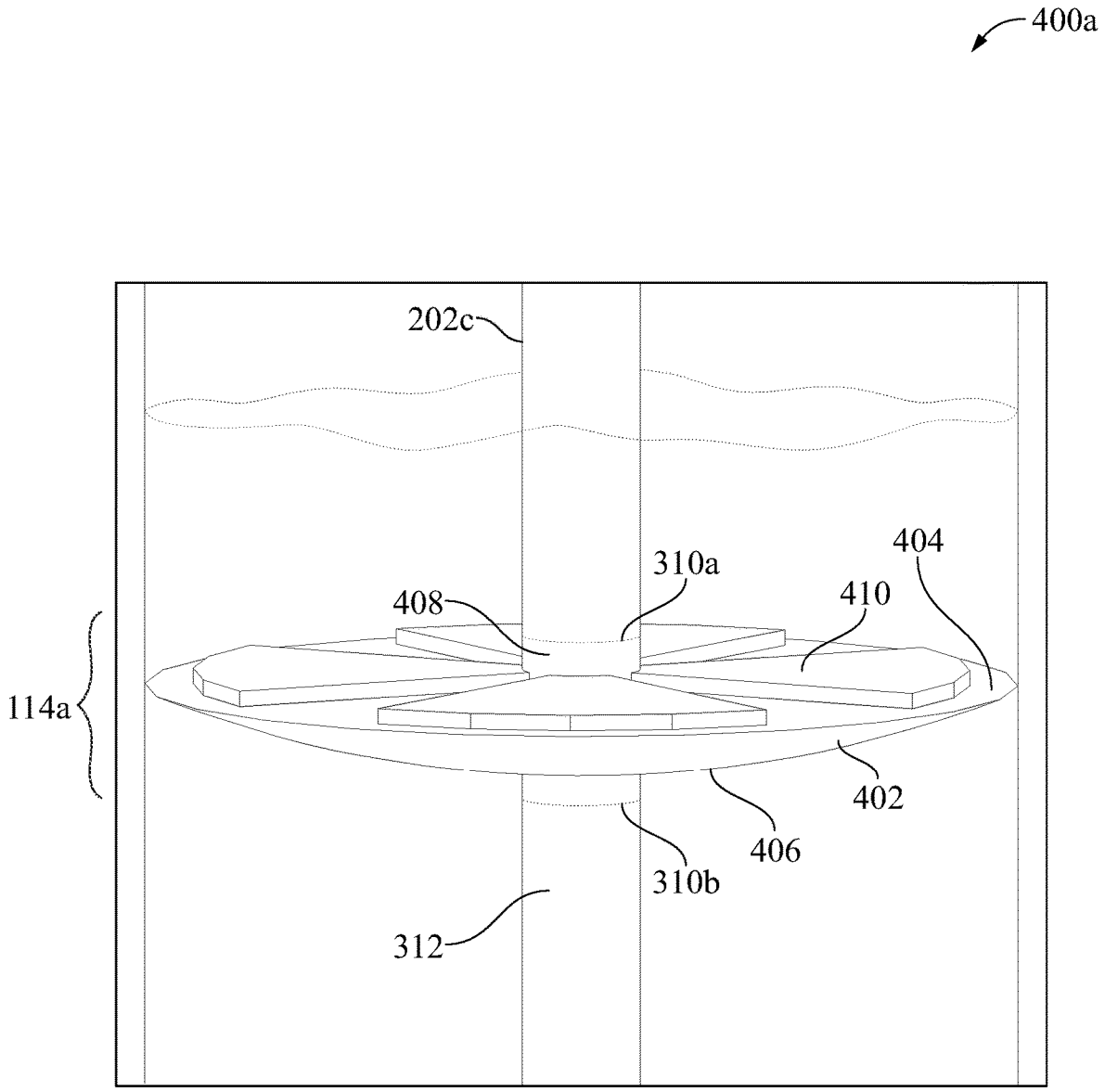
FIG. 4A is a side view of a first implementation of a sealing element as illustrated in FIGS. 1-3, according to an implementation.

FIG. 4A is a side view 400*a* of a first implementation of a sealing element as illustrated in FIGS. 1-3, according to an implementation. As illustrated, sealing element 114*a* is coupled with rod segment 202*c* (uphole direction) and with a connecting rod 312 (connected in the downhole direction to sealing element 114*b* (not illustrated). Sealing element 114*a* includes a circular sealing cup 402, support member 408, and stiffness element 410.

As previously described, circular sealing cup 402 is configured in a circular shape and of an elastomeric-type material (for example, rubber, silicon, or other pliant, resilient material) providing an outward spring bias when compressed and capable of generating at least a substantially hermetic-type seal against the inner wall of the wellbore casing 108. The circular sealing cup 402 can be configured to be of varying thickness across the diameter of the circular sealing cup 402 depending upon desired use. The circular sealing cup 402 (as part of sealing element 114*a*) is also typically configured to be of a slightly larger diameter than the inner wall of the wellbore casing 108 to provide a tight fit/seal against the inner wall of the wellbore casing 108. The flat upper portion 404 of circular sealing cup 402 is oriented in the uphole direction (direction of the grips 204) with a curved lower portion 406 oriented in the downhole direction. In some implementations, circular sealing cup 402 can be configured to include a concave upper portion (not illustrated) oriented in the uphole direction.

When inserted into the wellbore casing 108, the circular sealing cup 402 can deform to provide at least a substantially hermetic-type seal against the inner wall of the wellbore casing 108. In other implementations, the circular sealing cup 402 can be configured to be a disc shape of substantially equal thickness along the diameter of the circular sealing cup 402.

The sealing element 114*a* also includes a support member 408 situated at the center of the circular sealing cup 402. Support member 408 is configured as a central post extending laterally in both the uphole and downhole direction with female-threaded uphole attachment point 310*a* and female-threaded downhole attachment point 310*b*. Support member 408 provides support for the circular sealing cup 402 when attached to rod segment 202*c* and connecting rod 312. In typical implementations, the support member 408 is molded into material of the circular sealing cup 402 to form a gas/fluid-tight seal between the support member 408 and the circular sealing cup 402. In other implementations, the circular sealing cup can be configured to define a female-threaded central hole and the exterior of the support member 408 can be configured with male threading. The support member can then be screwed down into the circular sealing cup 402 until the stiffness element 410 makes contact with the flat upper portion 404 of the circular sealing cup 402, thereby securing the circular sealing cup 402 to the support member 408 and forming a gas/fluid-tight seal between the support member 408 and the circular sealing cup 402. In this implementation, an adhesive or other substance can be used to create or to assist with gas/fluid-tight seal between the support member 408 and the circular sealing cup 402. In other implementations, the circular sealing cup 402 can be adhered to the support member 408 using an adhesive and forming a gas/fluid-tight seal between the support member 408 and the circular sealing cup 402.

The support member 408 includes one or more stiffness elements 410 to providing a resistive spring bias/stiffness to the circular sealing cup 402 when inserted into the wellbore casing 108. In typical implementations, stiffness elements 410 are coupled to support member 408 (for example, using welding, adhesive, or threaded surfaces). The one or more stiffness elements 410 prevent the circular sealing cup 402 from collapsing inward when pushed into the wellbore casing 108 and to return the circular sealing cup 402 to its default shape once removed from the wellbore casing 108. In some implementations, the stiffness elements 410 can radiate outwardly from the support member toward the inner wall of the wellbore casing 108. In other implementations, the one or more stiffness elements 410 can be a single disc surrounding the support member 408 and extending over the flat upper portion 404 of the circular sealing cup 402. For example, the one or more stiffness elements can extend outwardly from the support member 408 approximately three-quarters of the radius of the uncompressed circular sealing cup 402. This configuration provides needed stiffness while allowing for flexibility at the edge of the circular sealing cup 402.

The support member 204 can me made of any material sufficiently stiff enough to support the circular sealing cup 202, such as metal, plastic, fiberglass, carbon fiber, composite or any other sufficiently stiff material. The one or more stiffness elements 410 can me made of any material with sufficient spring bias, such as metal, plastic, fiberglass, carbon fiber, composite or any other material.

Figure 4B:
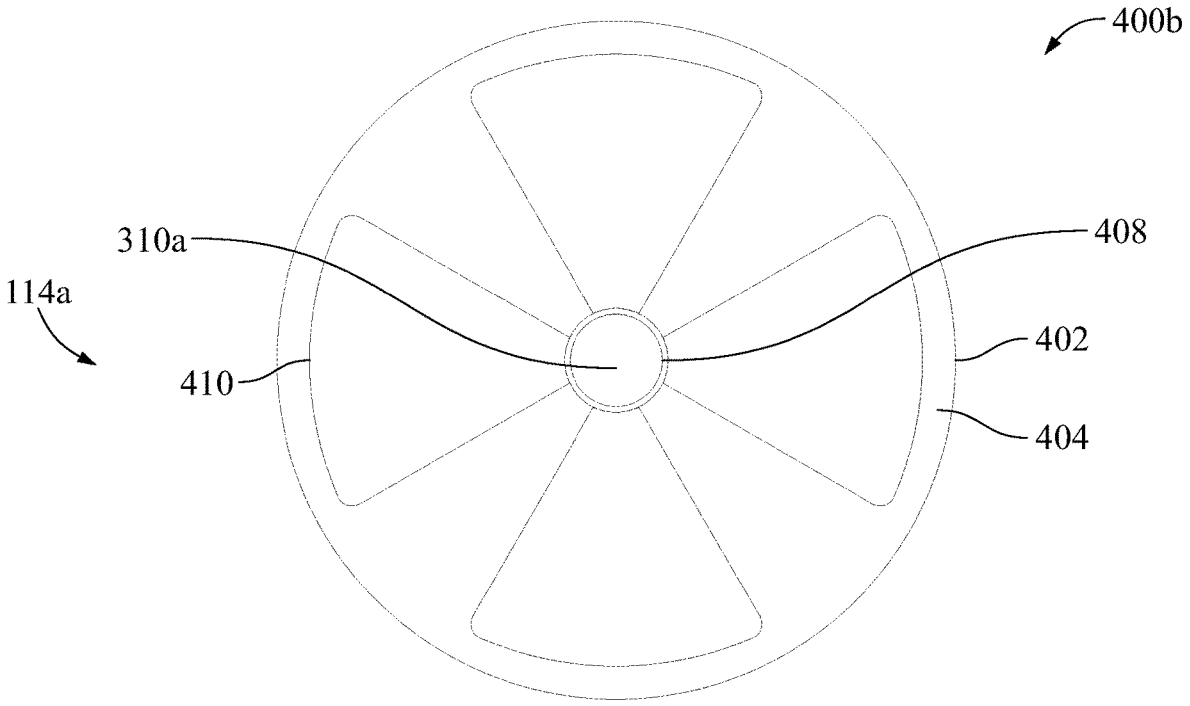
FIG. 4B is a top view of a first implementation of a sealing element as illustrated in FIGS. 1-3 and 4A, according to an implementation.

FIG. 4B is a top view 400*b* of a first implementation of a sealing element as illustrated in FIGS. 1-3 and 4A, according to an implementation. As illustrated, support member 408 includes four stiffness elements 410 extending outwardly from the support member 408 along the flat upper portion 404 of the circular sealing cup 402.

Figure 4C:
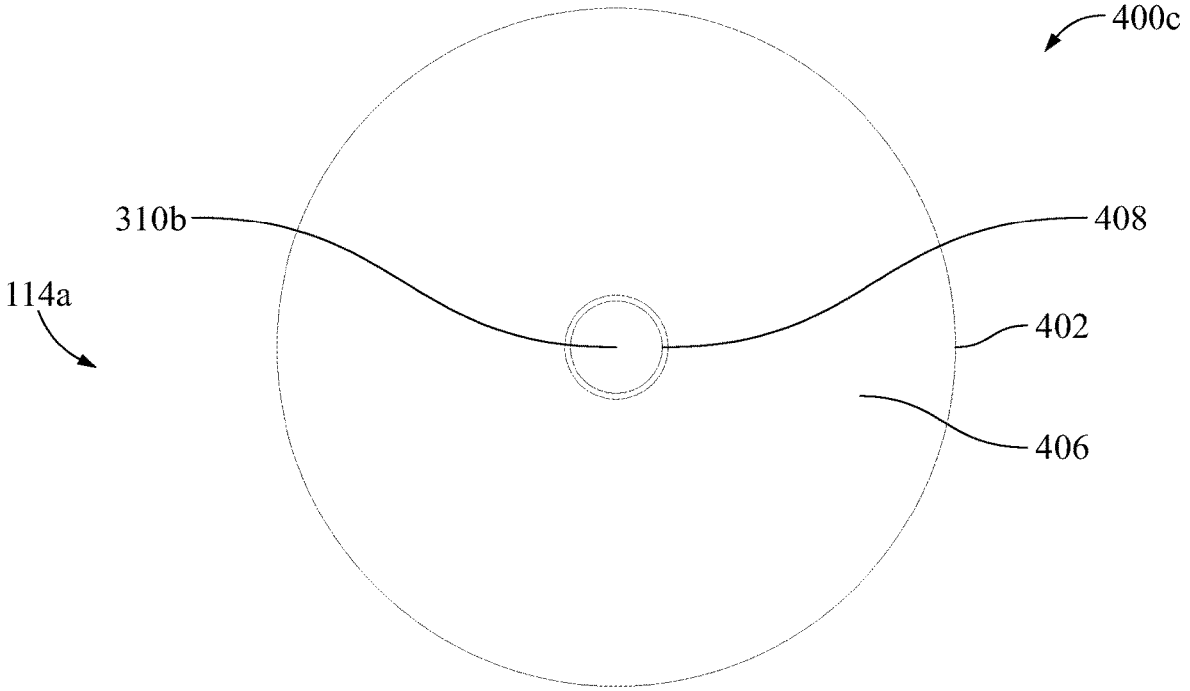
FIG. 4C is a bottom view of a first implementation of a sealing element as illustrated in FIGS. 1-3, 4A, and 4B, according to an implementation.

FIG. 4C is a bottom view 400*c* of a first implementation of a sealing element as illustrated in FIGS. 1-3, 4A, and 4B, according to an implementation. As illustrated, downhole attachment point 310*b* of support member 408 is accessible from the curved bottom portion 406 of circular sealing cup 402.

Figure 5:
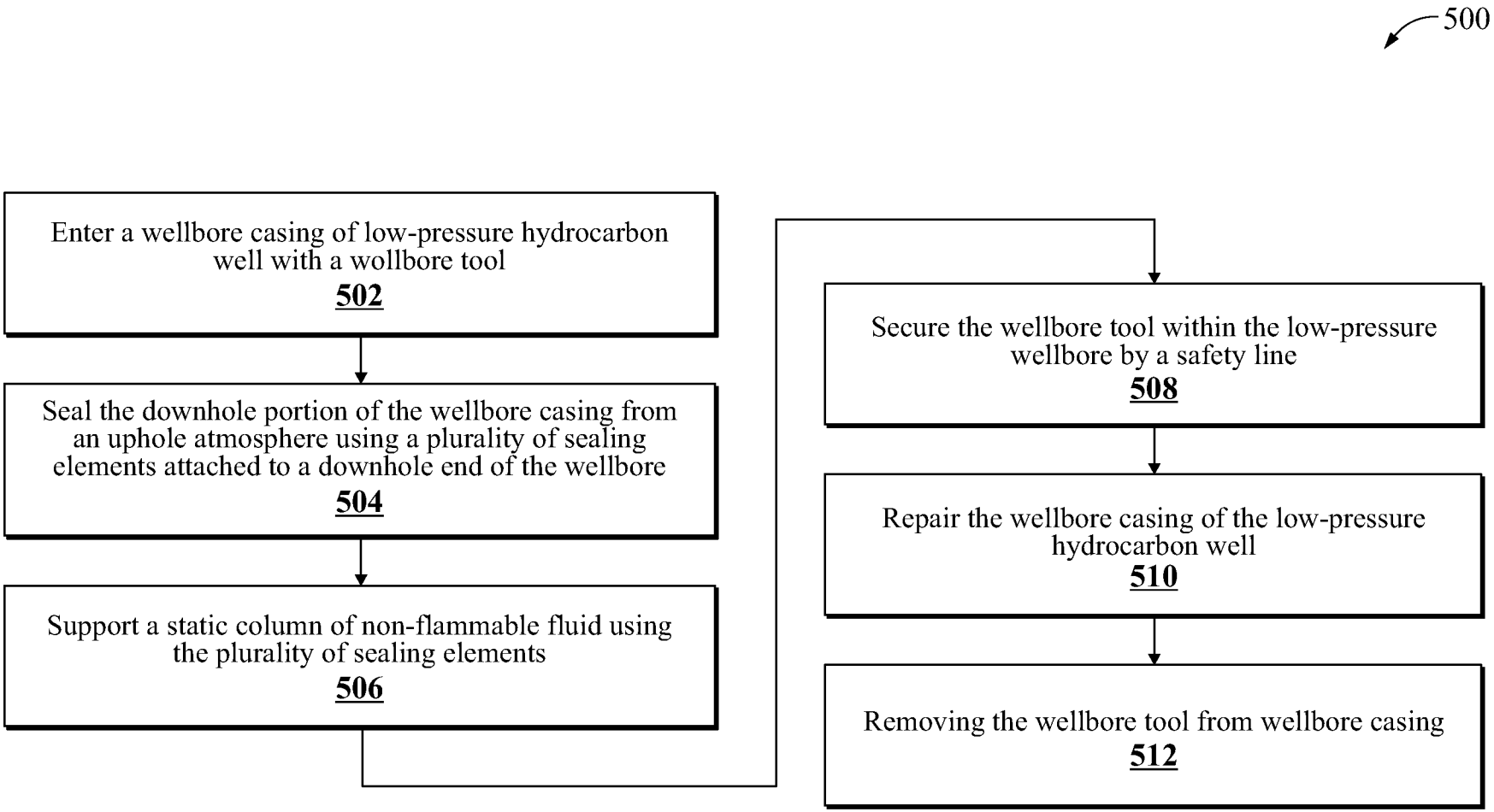
FIG. 5 is a flowchart of an example method of use of the previously-described first implementation of the wellbore tool of FIGS. 1-3 and 4A-4C, according to an implementation.

FIG. 5 is a flowchart of an example method 500 of use of the previously-described first implementation of the wellbore tool of FIGS. 1-3 and 4A-4C, according to an implementation. For clarity of presentation, the description that follows generally describes method 500 in the context of FIGS. 1-3 and 4A-4C in this description.

In this example of use, an uphole portion of wellbore casing within low-pressure wellbore of a hydrocarbon well is damaged (for example, a hole, crack, or leak due to previously-described corrosion/material loss or other type of damage). As damage typically occurs to the wellbore casing beneath the surface of the earth, the earth around the wellbore casing is excavated and cleared to expose the damaged portion of the wellbore casing. To permit repair of the wellbore casing (either by replacement or patching), the wellbore casing must be sealed below the damaged portion to prevent toxic or flammable/combustible gases/fluids from being present during repair operations.

At 502, a wellbore casing of low-pressure hydrocarbon tool is entered with a wellbore tool. A user would assemble the wellbore tool (if necessary) with rod and a plurality of sealing elements of the appropriate inner diameter of the wellbore casing. The lower sealing element of the assembled wellbore tool is then inserted into the damaged wellbore casing and pushed downward (for example, by grasping the grips on the uphole portion of the wellbore tool) and pushing/pulling in a downhole direction). The wellbore tool is inserted into the wellbore casing so that the upper (furthest uphole) sealing element is downhole from the damaged portion of the wellbore casing. Typically, the wellbore tool can be inserted into the wellbore casing to a desired depth by human intervention only. Bulky/heavy machinery is not necessary to insert, position, or remove the wellbore tool into, within, or from, respectively, the wellbore. From 502, method 500 proceeds to 504.

At 504, the downhole portion of the wellbore casing is sealed from an uphole atmosphere using the plurality of sealing elements attached to the downhole end of the wellbore tool. Each sealing element deforms slightly as it is inserted into the wellbore casing and forms a hermetic-type seal against the inner wall of the wellbore casing from gases/fluids downhole in the wellbore casing to substantially seal the downhole portion of the wellbore casing from an uphole atmosphere. From 504, method 500 proceeds to 506.

At 506, a static column of non-flammable/non-combustible fluid (for example, water) is supported using the plurality of sealing elements. Once the wellbore tool is positioned in the wellbore casing, a static column of a non-flammable/non-combustible fluid is inserted into the wellbore casing to a level uphole from the upper sealing element but downhole of the damaged portion. The non-flammable/non-combustible fluid may also flow to fill the spaces between the upper sealing element and one or more additional sealing elements downhole from the upper sealing element to provide additional sealing of the wellbore casing if necessary. The addition of the non-flammable/non-combustible fluid provides additional hermetic-type sealing of the wellbore casing to isolate any potential toxic or flammable/combustible gas/fluid produced within the wellbore casing from migrating upward toward the uphole-end of the wellbore casing proximate to the damaged portion. The fluid level of non-flammable/non-combustible fluid should be sufficient to provide an adequate static head for sealing of the lower wellbore casing from the uphole portion of the wellbore casing and to provide enough fluid volume to absorb heat from any sparks or open-flame from cutting, welding, or other operations during repair of the wellbore casing. From 506, method 500 proceeds to 508.

At 508, the wellbore tool is secure within the low-pressure wellbore by a safety line. To prevent the wellbore tool from falling into the wellbore casing out of reach of the user, the wellbore tool can be secured by attaching a cable, rope, or other type of safety line to the wellbore tool at a safety line attachment point (for example, a ring or other structure) and securing the safety line to a point external to the wellbore casing (for example, to a vehicle, support frame or stake in the earth) or to a portion of the wellbore casing itself. The safety line typically includes a carabiner-type "clip" or other structure to permit the safety line to be easily attached to/detached from the safety line attachment point. From 508, method 500 proceeds to 510.

At 510, the wellbore casing of the low-pressure hydrocarbon well is repaired. Typically, the damaged portion of the wellbore casing portion requires that the wellbore casing be cut off at or slightly below the damaged portion of the wellbore casing as long as structurally sound wellbore casing is left to effect a repair to the wellbore casing. In other instances, the damaged portion can be patched (for example, with a welded patch or collar of wellbore casing or other material) and without the need to cut and remove an entire section of wellbore casing. From 510, method 500 proceeds to 512.

At 512, the wellbore tool is removed from the wellbore casing. Once repairs are completed to the wellbore casing, the wellbore tool can be pulled from the wellbore casing either by hand or with the assistance of a winch or similar device if necessary. Removing the wellbore tool from the wellbore casing will also cause the sealing elements to remove the non-flammable/non-combustible fluid from the wellbore casing. The wellbore tool can then be configured (for example, disassembled or collapsed) for storage or movement to another location for use. After 512, method 500 stops.

Figure 6A:
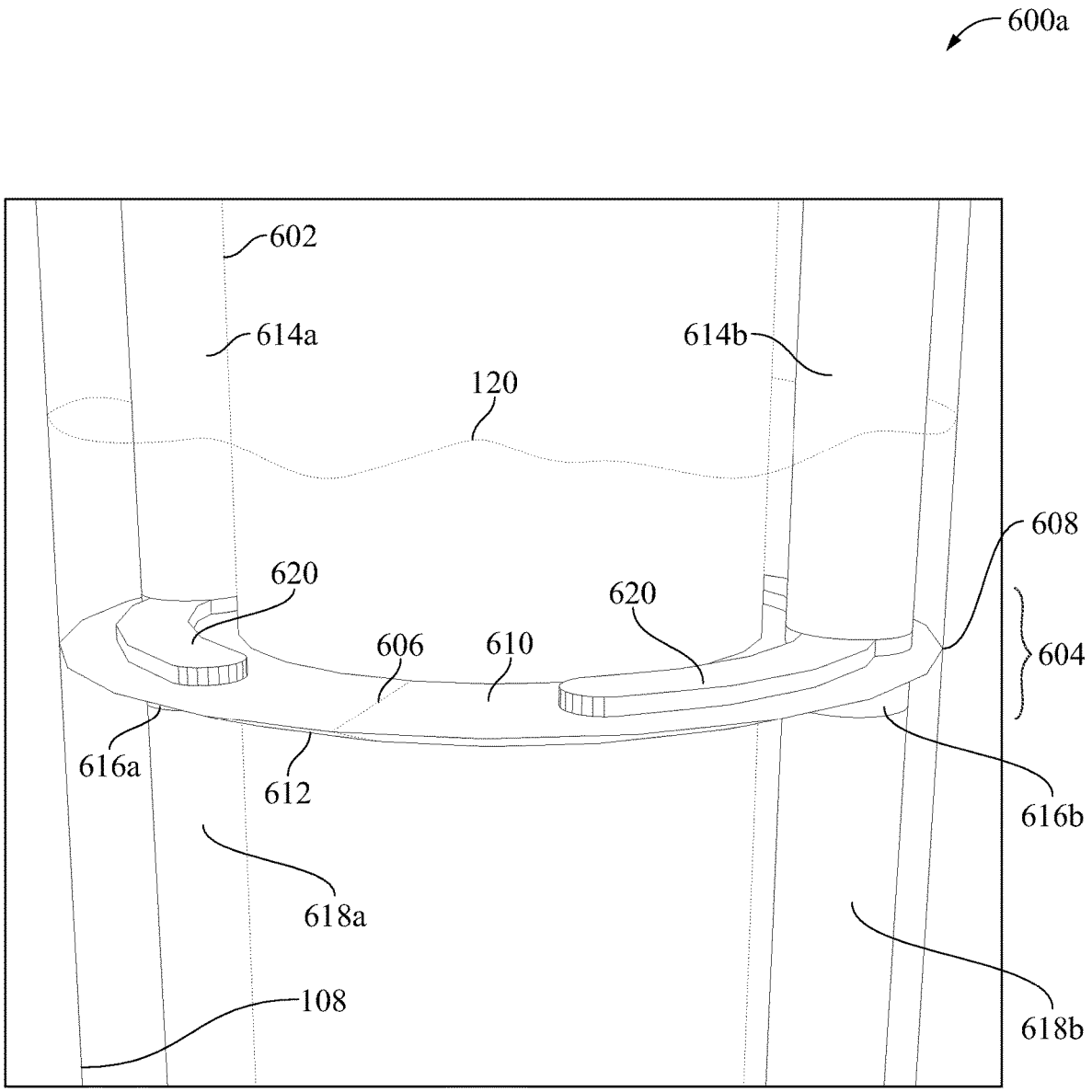
FIG. 6A is a side view of a second implementation of a sealing element, according to an implementation.

FIG. 6A is a side view 600*a* of a second implementation of a sealing element, according to an implementation. In some circumstances, a wellbore casing 108 of a low-pressure hydrocarbon well may contain an additional tubing, casing, pipe, or other obstruction (hereinafter "tubing") 602 positioned within the wellbore casing 108 that would prevent insertion of sealing elements of the wellbore tool implementation of FIGS. 1-3, 4A-4C, and 5 into the wellbore casing 108 and sealing the downhole portion of the wellbore casing 108 from an uphole atmosphere. An example of tubing 602 can include a production packer with a smaller piece of tubing that is stuck within a wellbore casing. Note that, in this situation, a smaller version of the wellbore tool described in FIGS. 1-3 and 4A-4C can be used to plug the smaller piece of tubing to prevent escape of toxic or flammable/combustible gases/fluids through the smaller piece of tubing.

In this case, an alternatively-designed sealing element 604 is also necessary to permit the sealing element 604 to pass around the tubing 602 and to move downward into the wellbore casing 108 to create a seal between the tubing 602 and the inner wall of the wellbore casing 108.

Similar to the previously-described sealing element 114, sealing element 604 can deform when inserted into wellbore casing 108/around tubing 602 to provide at least a substantially hermetic-type seal against the inner wall of the wellbore casing 108 and the outer surface of the tubing 602 downhole from a damaged portion of the wellbore casing 108. A wellbore tool configured with one or more sealing elements 604 can be used with a non-flammable/non-combustible fluid (for example, water) to provide additional wellbore casing sealing functionality.

In typical implementations, circular sealing cup 608 is configured to define an inner void 603 (not illustrated—refer to FIGS. 6B and 6C) to pass around tubing 602. Circular sealing cup 608 is also configured with a slice 606 that traverses from the outer edge of the circular sealing cup 608 to the outer edge of the defined inner void 603. The slice 606 permits the circular sealing cup 608 to deform/separate in order to pass over sections of the tubing 602 that may be larger or around some obstruction present along the outer surface of the tubing 602 downhole in the wellbore casing 108. As soon as the circular sealing cup 608 is pushed passed any obstruction, a stiffness element (not illustrated) and the pressure against the outer surface of the circular sealing cup will force the circular sealing cup 608 back into a configuration with the slice "closed" and preserving a hermetic-type seal with the circular sealing cup 608.

Circular sealing cup 608 is configured in a circular shape and of an elastomeric-type material (for example, rubber, silicon, or other pliant, resilient material) providing an outward spring bias when compressed and capable of generating at least a substantially hermetic-type seal against the inner wall of the wellbore casing 108 and the outer wall of the tubing 602. The circular sealing cup 608 can be configured to be of varying thickness across the diameter of the circular sealing cup 608 depending upon desired use. The circular sealing cup 608 (as part of sealing element 604) is also typically configured to be of a slightly larger diameter than the inner wall of the wellbore casing 108 to provide a tight fit/seal against the inner wall of the wellbore casing 108 and approximately the same size as the outer diameter of the tubing 602 to provide a tight fit/seal against the outer wall of the tubing 602.

Circular sealing cup 608 can be configured with a flat upper portion 610 of circular oriented in the uphole direction with a curved lower portion 612 oriented in the downhole direction. In some implementations, circular sealing cup 608 can be configured to include a concave upper portion (not illustrated) oriented in the uphole direction. In other implementations, the circular sealing cup 608 can be configured to be a disc shape of substantially equal thickness along the diameter of the circular sealing cup 608.

Figure 6B:
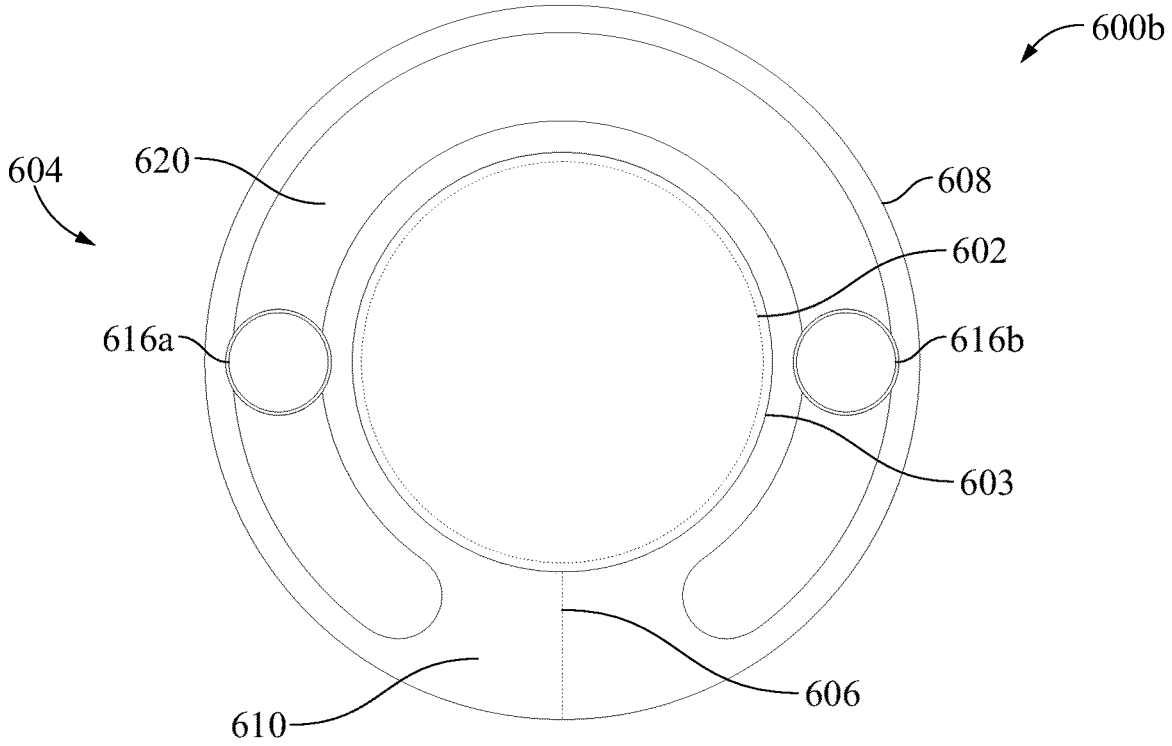
FIG. 6B is a top view of a second implementation of a sealing element, according to an implementation.

In order to manipulate a wellbore tool configured with one or more sealing elements 604 (similar to the configuration of the wellbore tool 102 in FIGS. 1-3), the circular sealing cup 608 is configured to engage with two separate rods 614*a*/6124*b* positioned directly opposite to each other on the outer edge of the circular sealing cup 608 (refer to FIG. 6B). Each of rods 614*a*/614*b* can be configured as previously described (for example, as a single, non-segmented rod; multiple rod segments; or multiple telescoping rod segments 624 as shown in FIG. 6F) in all applicable aspects with respect to rod 202 (and rod segments 202*a*, 202*b*, and 202*c*). For example, each of rods 614*a*/614*b* can include grips (not illustrated) similar to grips 204, and a safety line attachment point (not illustrated) similar to safety line attachment point 206. When the wellbore tool configured with one or more sealing elements 604 is inserted into the wellbore casing and around the tubing 602, the two rods 614*a*/614*b* can each be manipulated (for example, with applied downhole force) to push the sealing element 604 downhole into the wellbore casing 108.

The sealing element 604 is configured to include two support members 616*a*/616*b* positioned directly opposite to each other on the outer edge of the circular sealing cup 608 (refer to FIG. 6B). Each of support members 616*a*/616*b* can be configured, as previously described, in all applicable aspects with respect to support member 408 and circular sealing cup 402. For example, support members 616*a*/616*b* can connect with rods 614*a*/614*b* (each similar to the previously-described rod segment 202*c*) and with connecting rods 618*a*/618*b* (each similar to the previously-described connecting rod 312) used to connect the sealing element 604 to another downhole sealing element 604. Each of support members 616*a*/616*b* can also connect to a plug as previously described (not illustrated).

Sealing element 604 also includes a stiffness element 620. Stiffness element 620 is configured in a C/horseshoe-shape and positioned on the upper flat portion 610 of the circular sealing cup 608 and traverses along a substantial portion of the circumference of the flat upper portion 610 of the circular sealing cup 608 (refer to FIG. 6B). In typical implementations, stiffness element 620 is coupled to both support members 616*a*/616*b* (for example, using welding, adhesive, or threaded surfaces).

FIG. 6B is a top view 600*b* of the second implementation of a sealing element as illustrated in FIG. 6A, according to an implementation. As illustrated, the support members 616*a*/616*b* are coupled with a 'C'/horseshoe-shaped stiffness element 620 along the flat upper portion 610 of the circular sealing cup 608. Circular sealing cup 608 is configured to define an inner void 603 to pass around tubing 602. Circular sealing cup 608 is also configured with a slice 606 that traverses from the outer edge of the circular sealing cup 608 to the outer edge of the defined inner void 603.

Figure 6C:
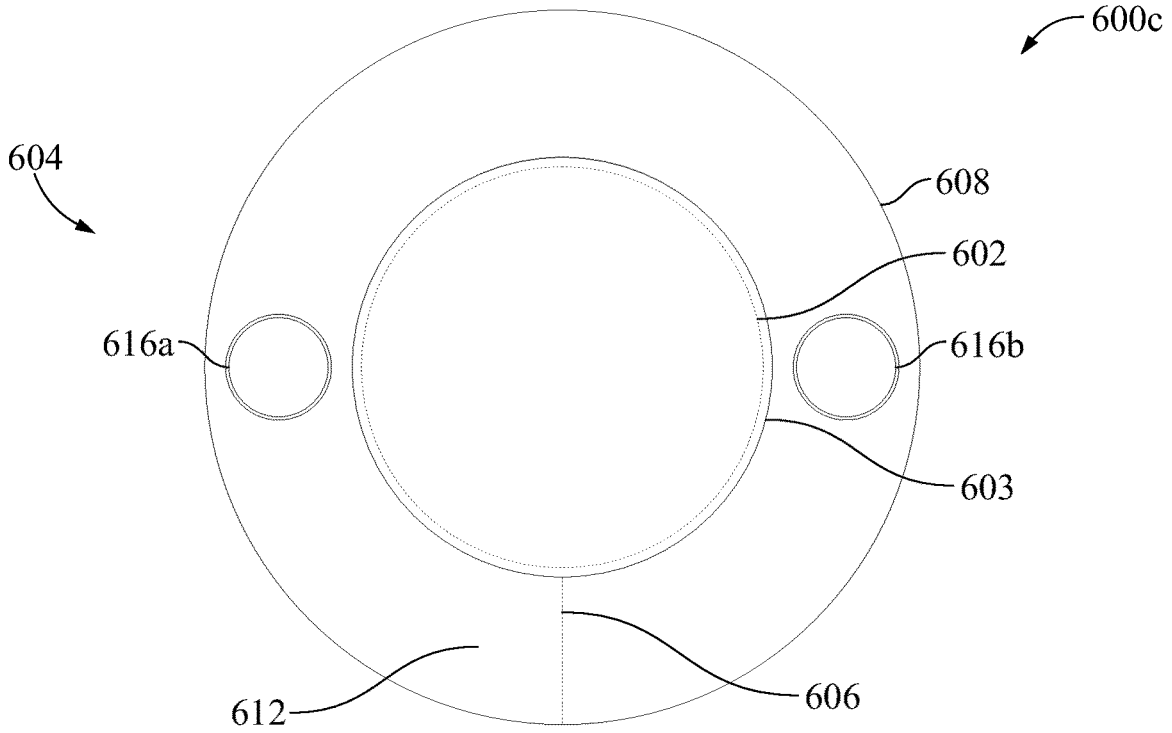
FIG. 6C is a bottom view of the second implementation of the sealing element as illustrated in FIGS. 6A and 6B, according to an implementation.

FIG. 6C is a bottom view 600*c* of the second implementation of the sealing element as illustrated in FIGS. 6A and 6B, according to an implementation. As illustrated, downhole attachment points for support members 616*a*/616*b* are accessible from the curved bottom portion 612 of circular sealing cup 608.

Figure 6D:
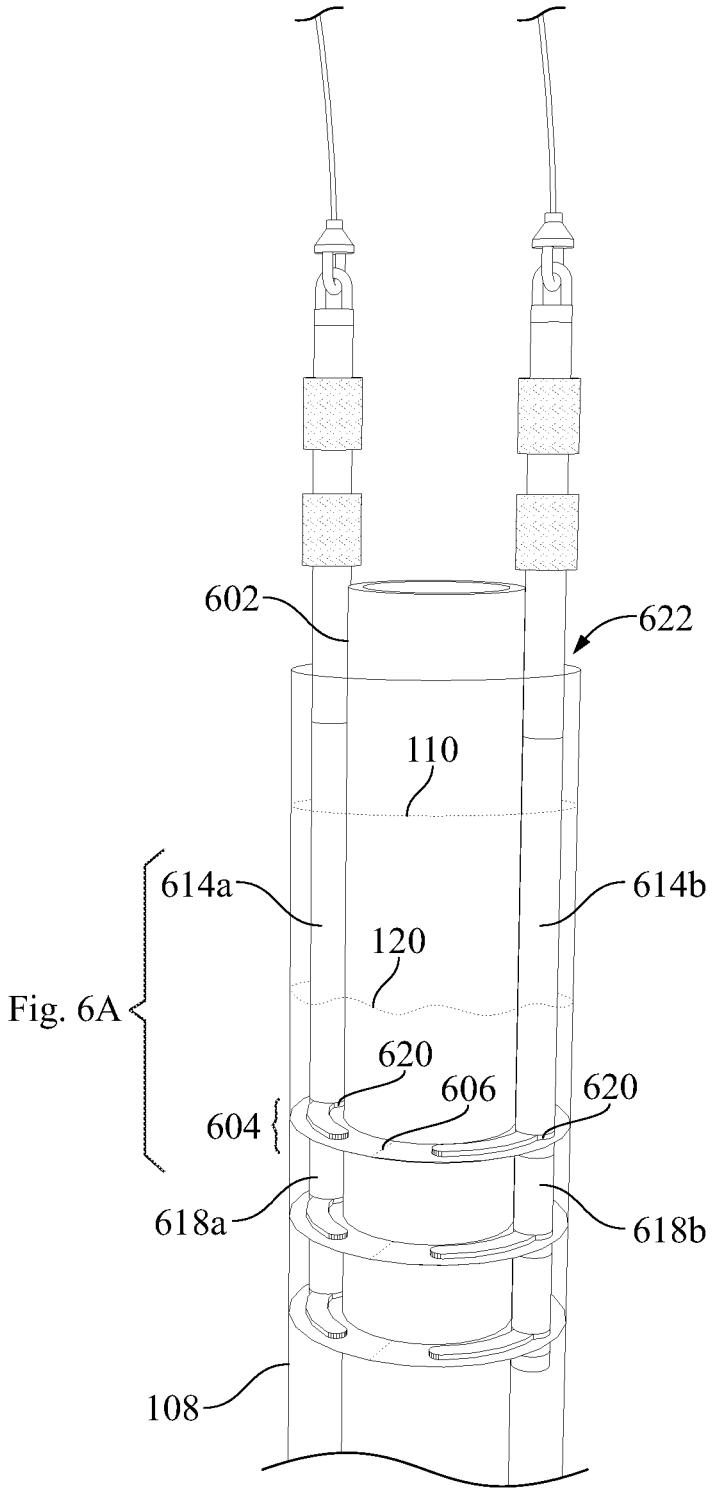
FIG. 6D is a perspective view of an alternative wellbore tool configured to use the second implementation of the sealing element as illustrated in FIGS. 6A-6C, according to an implementation.

FIG. 6D is a perspective view 600*d* of an alternative wellbore tool 622 configured to use the second implementation of the sealing element as illustrated in FIGS. 6A-6C, according to an implementation. The wellbore tool 622 is illustrated inserted into a wellbore casing 108 with each sealing element 604 positioned around tubing 602. In the illustrated implementation, each rod 614*a*/614*b* is similar in configuration to rod 202 as illustrated in FIG. 2. Note that the alternative wellbore tool 622 is shown configured with only two rod segments (as previously described) for illustrative purposes. Implementations of the alternative wellbore tool 622 can be configured with different numbers of rod segments depending upon a particular needed length.

Figure 6E:
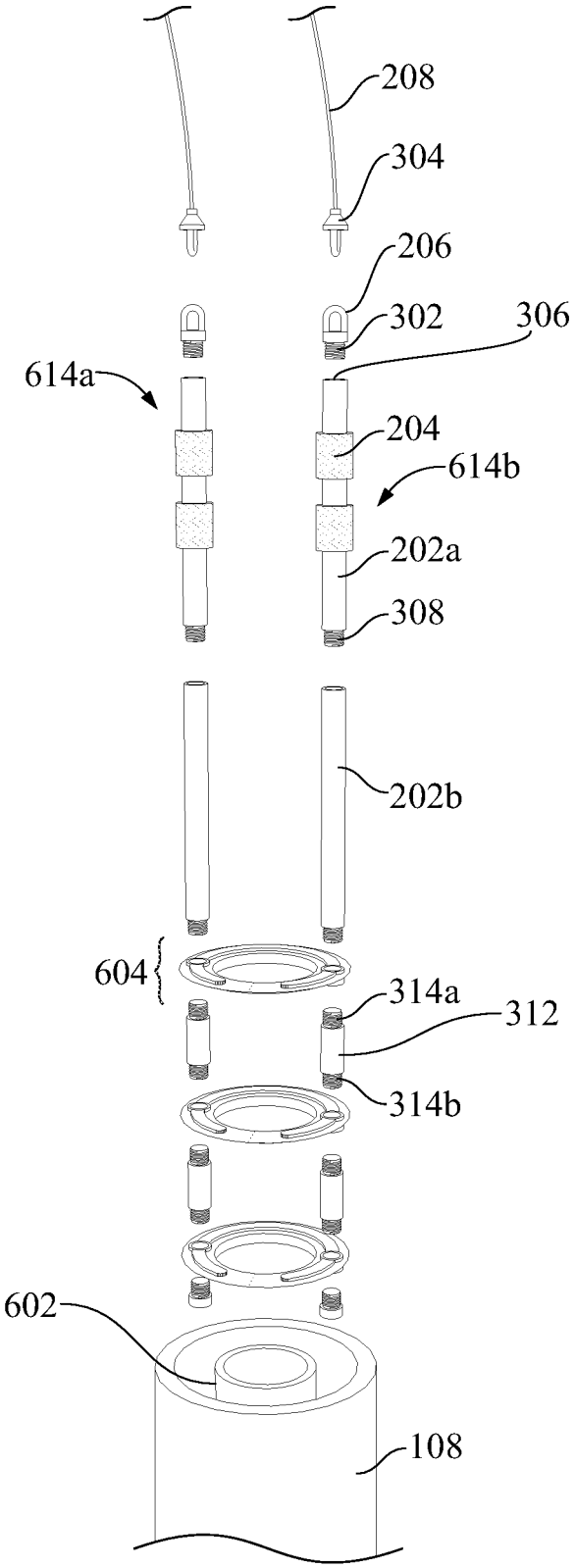
FIG. 6E is an exploded perspective view of the wellbore tool of FIGS. 6A-6D, according to an implementation.
Figure 6F:
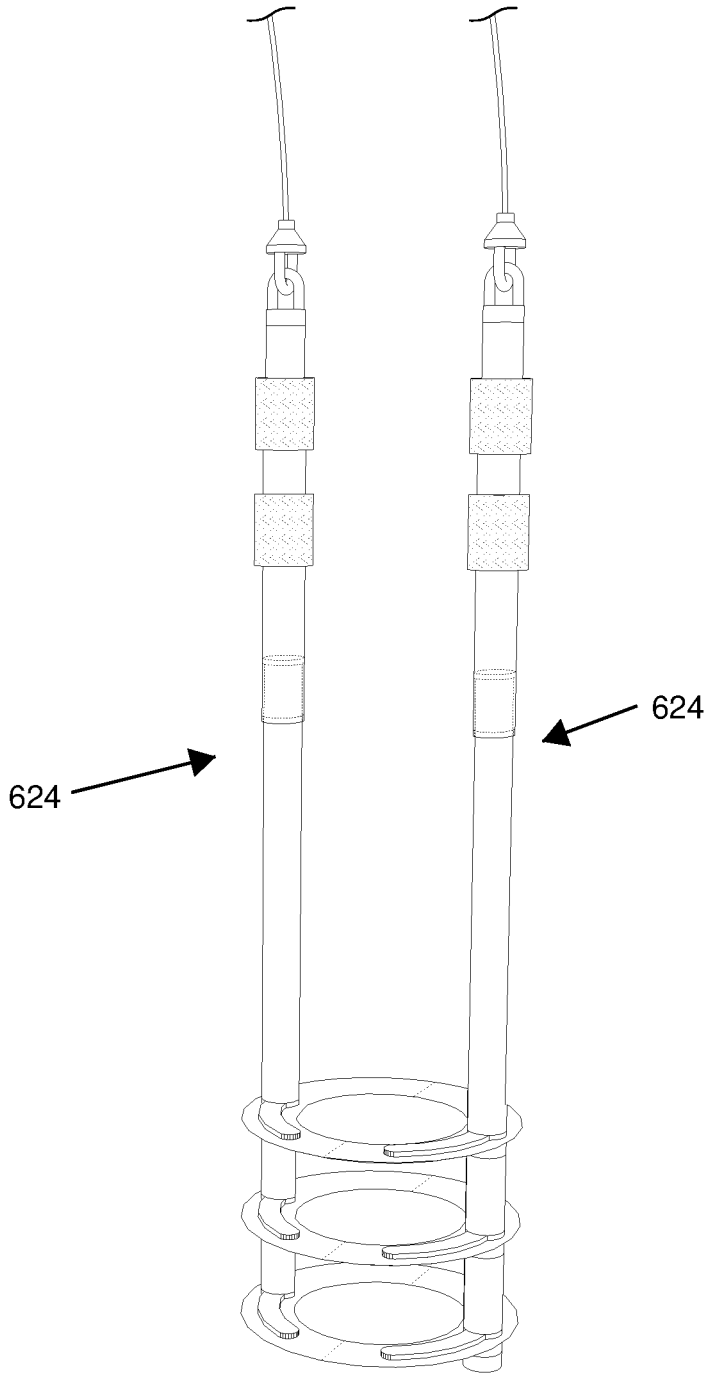
FIG. 6F is a perspective view of a wellbore tool with collapsible sections.

FIG. 6E is an exploded perspective view 600*e* of the wellbore tool 622 of FIGS. 6A-6D, according to an implementation. In the illustrated implementation, elements of each rod 614*a*/614*b*, except for sealing element 604, are similar to elements illustrated in FIG. 3. For example, in the case where a wellbore 106 contains tubing 602, two rods 202 (as illustrated in FIGS. 2A and 3) used for wellbore tool 102 can be used with sealing elements 604 to configure an instance of the wellbore tool 622 for use. This interchangeability of components ensures simple configurability, adaptability to varying use cases, and lower overall costs due to multiple potential uses for components of the wellbore tool 622. In other implementations, the illustrated elements of rods 614*a*/614*b* can vary, as previously-described, and consistent with the subject matter of this disclosure. Note that the alternative wellbore tool 622 is shown configured with only two rod segments (as previously described) for illustrative purposes. Implementations of the alternative wellbore tool 622 can be configured with different numbers of rod segments depending upon a particular needed length.

Figure 7:
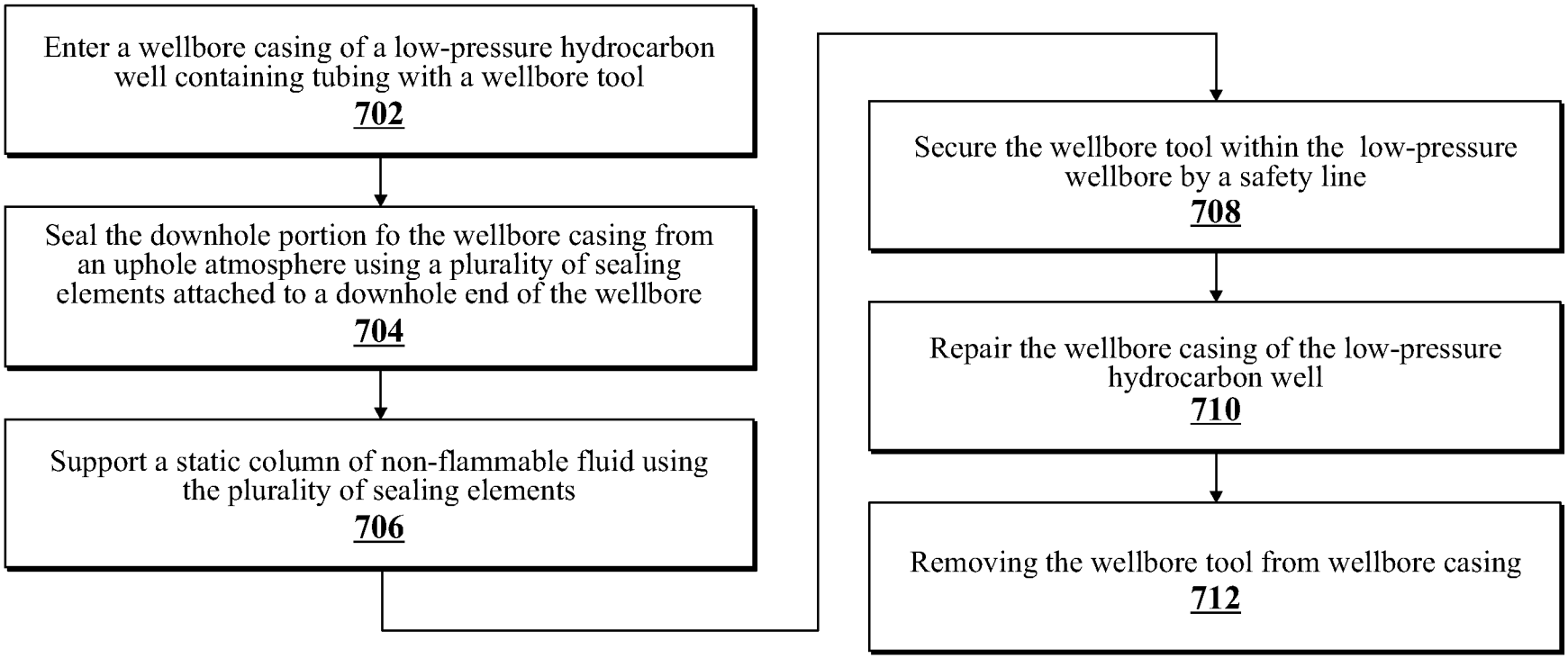
FIG. 7 is a flowchart of an example method of use of the previously-described second implementation of the wellbore tool, according to an implementation.

FIG. 7 is a flowchart of an example method 700 of use of the previously-described second implementation of the wellbore tool of FIGS. 6A-6B, according to an implementation. For clarity of presentation, the description that follows generally describes method 700 in the context of FIGS. 1-3, 4A-4C, and 6A-6B in this description.

In this example of use, an uphole portion of wellbore casing containing additional tubing and within low-pressure wellbore of a hydrocarbon well is damaged (for example, a hole, crack, or leak due to previously-described corrosion/material loss or other type of damage). As damage typically occurs to the wellbore casing beneath the surface of the earth, the earth around the wellbore casing is excavated and cleared to expose the damaged portion of the wellbore casing. To permit repair of the wellbore casing (either by replacement or patching), the wellbore casing must be sealed below the damaged portion to prevent toxic or flammable/combustible gases/fluids from being present during repair operations.

At 702, a wellbore casing of low-pressure hydrocarbon tool is entered with a wellbore tool. A user would assemble the wellbore tool (if necessary) with two rods and a plurality of sealing elements configured with appropriate inner diameter of the wellbore casing/outer diameter of the contained tubing. The lower sealing element of the assembled wellbore tool is then inserted into the damaged wellbore casing and over/around tubing contained in the wellbore casing and pushed downward (for example, by grasping grips on the uphole portions of the wellbore tool) and pushing/pulling in a downhole direction). The wellbore tool is inserted into the wellbore casing so that the upper (furthest uphole) sealing element is downhole from the damaged portion of the wellbore casing. Typically, the wellbore tool can be inserted into the wellbore casing to a desired depth by human intervention only. Bulky/heavy machinery is not necessary to insert, position, or remove the wellbore tool into, within, or from, respectively, the wellbore. From 702, method 700 proceeds to 704.

At 704, the downhole portion of the wellbore casing is sealed from an uphole atmosphere using the plurality of sealing elements attached to the downhole end of the wellbore tool. Each sealing element deforms slightly as it is inserted into the wellbore casing and forms a hermetic-type seal against the inner wall of the wellbore casing and the outer wall of the tubing from gases/fluids downhole in the wellbore casing to substantially seal the downhole portion of the wellbore casing from an uphole atmosphere. From 704, method 700 proceeds to 706.

At 706, a static column of non-flammable/non-combustible fluid (for example, water) is supported using the plurality of sealing elements. Once the wellbore tool is positioned in the wellbore casing, a static column of a non-flammable/non-combustible fluid is inserted into the wellbore casing to a level uphole from the upper sealing element but downhole of the damaged portion. The non-flammable/non-combustible fluid may also flow to fill the spaces between the upper sealing element and one or more additional sealing elements downhole from the upper sealing element to provide additional sealing of the wellbore casing if necessary. The addition of the non-flammable/non-combustible fluid provides additional hermetic-type sealing of the wellbore casing to isolate any potential toxic or flammable gas/fluid produced within the wellbore casing from migrating upward toward the uphole-end of the wellbore casing proximate to the damaged portion. The fluid level of non-flammable/non-combustible fluid should be sufficient to provide an adequate static head for sealing of the lower wellbore casing from the uphole portion of the wellbore casing and to provide enough fluid volume to absorb heat from any sparks or open-flame from cutting, welding, or other operations during repair of the wellbore casing. From 706, method 700 proceeds to 708.

At 708, the wellbore tool is secure within the low-pressure wellbore by a safety line. To prevent the wellbore tool from falling into the wellbore casing out of reach of the user, the wellbore tool can be secured by attaching a cable, rope, or other type of safety line to one or both of the rods of the wellbore tool at a safety line attachment point (for example, a ring or other structure) and securing the safety line(s) to a point external to the wellbore casing (for example, to a vehicle, support frame, or stake in the earth) or to a portion of the wellbore casing itself. The safety line typically includes a carabiner-type "clip" or other structure to permit the safety line to be easily attached to/detached from a particular safety line attachment point. From 708, method 700 proceeds to 710.

At 710, the wellbore casing of the low-pressure hydrocarbon well is repaired. Typically, the damaged portion of the wellbore casing portion requires that the wellbore casing be cut off at or slightly below the damaged portion of the wellbore casing as long as structurally sound wellbore casing is left to effect a repair to the wellbore casing. In other instances, the damaged portion can be patched (for example, with a welded patch or collar of wellbore casing or other material) and without the need to cut and remove an entire section of wellbore casing. From 710, method 700 proceeds to 712.

At 712, the wellbore tool is removed from the wellbore casing. Once repairs are completed to the wellbore casing, the wellbore tool can be pulled from the wellbore casing either by hand or with the assistance of a winch or similar device if necessary. Removing the wellbore tool from the wellbore casing will also cause the sealing elements to remove the non-flammable/non-combustible fluid from the wellbore casing. The wellbore tool can then be configured (for example, disassembled or collapsed) for storage or movement to another location for use. After 712, method 700 stops.

In some implementations, one or more portions of the previously-described wellbore tool implementations can be configured to permit attachment of sensors, protective coverings, or any other item that could be used in a wellbore environment. As an example, with wellbore tool 102, a sensor package for video, audio, temperature, pressure, water detection, chemical detection (such as $H_2S$ or acids), orientation, or movement could be attached to the downhole attachment point 310*b* of sealing element 114*c* to provide downhole data for the user during hydrocarbon well repair operations.

In some implementations, a miniaturized computer system (for example, computer 802 described following) can be attached to or within the rod (or rod segment) of the wellbore tool or externally to the wellbore tool and connected to the wellbore tool using wires, cables, or wireless network connections. The computer can include, among other things, various sensors (for example, Global Positioning System (GPS), auditory, infrared, magnetic, temperature, pressure, orientation, and fluid/gas flow), a battery, a timer, light-emitting elements (for example, LEDs or bulbs), audio emitting elements, WIFI/wired/cellular networking capability, and the like. As an example of use, a computer-equipped wellbore tool could signal orientation angle or monitor downhole pressure at each sealing element.

The computer-equipped wellbore tool could be networked into a mobile device or local monitoring system (including other computer-equipped wellbore tools) to provide additional data to users. Alarms (for example, visual, auditory, or network messages) could be generated to alert users if pre-programmed thresholds are met or exceeded.

In some implementations, any of the previously-described components of implementations of the wellbore tool can be configured with one or more of the previously-described sensors. In some implementations, particular sensors can be attached to particular components of the wellbore tool for individual monitoring purposes (for example, a temperature sensor can be configured as part of the upper sealing element, but lower sealing elements can be configured without temperature sensors. In another example, chemical detectors could be configured into various location along the length of the rod (or rod segments) to permit detection of toxic or flammable/combustible gases/fluids. Other examples will be apparent to those of ordinary skill in the art.

Figure 8:
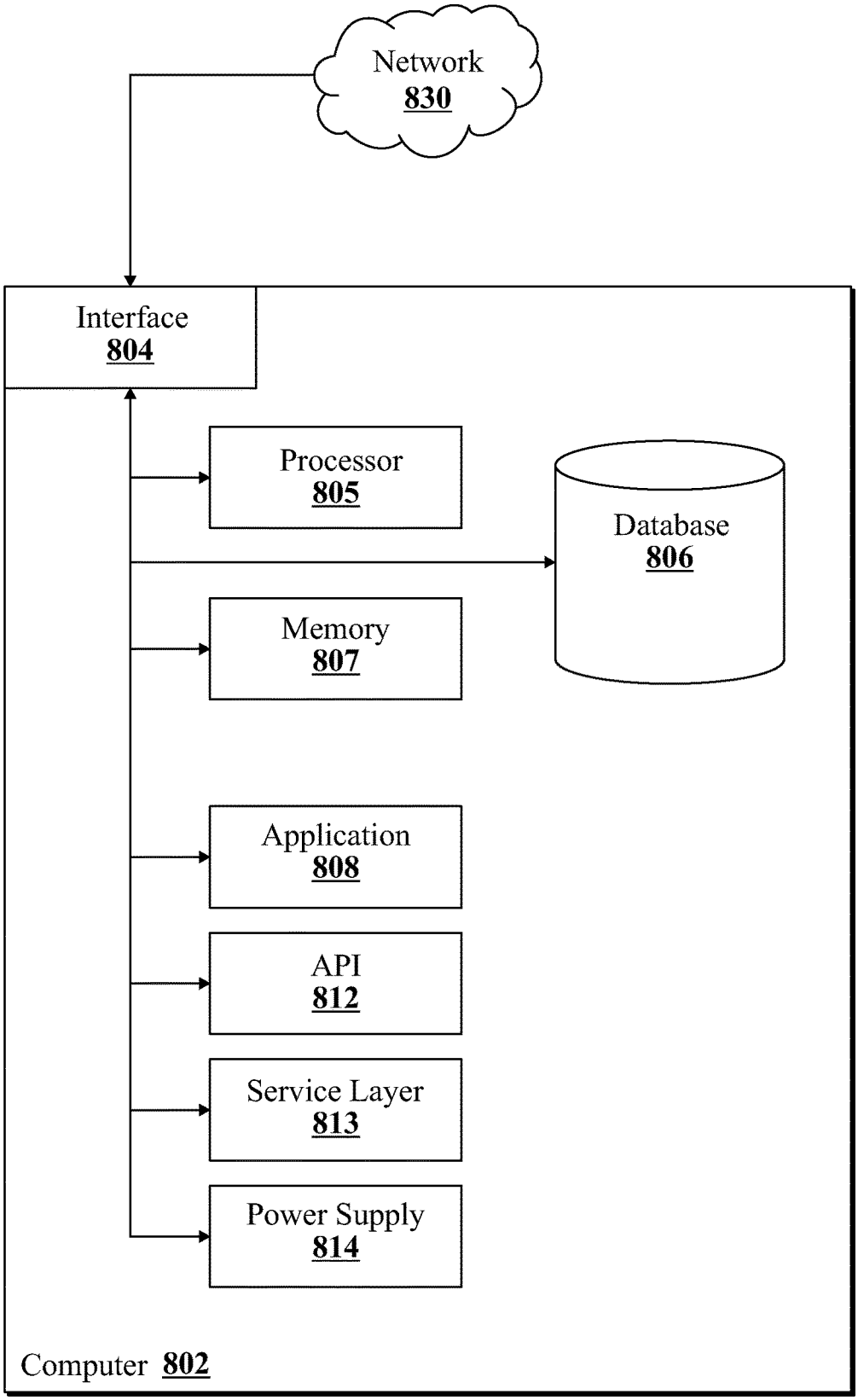
FIG. 8 is a block diagram illustrating an exemplary computer system used to provide computational functionalities associated with described algorithms, methods, functions, processes, flows, and procedures as described in the instant disclosure, according to an implementation.

FIG. 8 is a block diagram of an exemplary computer system 800 used to provide computational functionalities associated with described algorithms, methods, functions, processes, flows, and procedures as described in the instant disclosure, according to an implementation. The illustrated computer 802 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 802 may comprise a computer that includes an input device, such as a keypad, keyboard, touch screen, or other device that can accept user information, and an output device that conveys information associated with the operation of the computer 802, including digital data, visual, or audio information (or a combination of information), or a graphical user interface (GUI).

The computer 802 can serve in a role as a client, network component, a server, a database or other persistency, or any other component (or a combination of roles) of a computer system for performing the subject matter described in the instant disclosure. The illustrated computer 802 is communicably coupled with a network 830. In some implementations, one or more components of the computer 802 may be configured to operate within environments, including cloud-computing-based, local, global, or other environment (or a combination of environments).

At a high level, the computer 802 is an electronic computing device operable to receive, transmit, process, store, or manage data and information associated with the described subject matter. According to some implementations, the computer 802 may also include or be communicably coupled with an application server, e-mail server, web server, caching server, streaming data server, or other server (or a combination of servers).

The computer 802 can receive requests over network 830 from a client application (for example, executing on another computer 802) and responding to the received requests by processing the said requests in an appropriate software application. In addition, requests may also be sent to the computer 802 from internal users (for example, from a command console or by other appropriate access method), external or third-parties, other automated applications, as well as any other appropriate entities, individuals, systems, or computers.

Each of the components of the computer 802 can communicate using a system bus 803. In some implementations, any or all of the components of the computer 802, both hardware or software (or a combination of hardware and software), may interface with each other or the interface 804 (or a combination of both) over the system bus 803 using an application programming interface (API) 812 or a service layer 813 (or a combination of the API 812 and service layer 813). The API 812 may include specifications for routines, data structures, and object classes. The API 812 may be either computer-language independent or dependent and refer to a complete interface, a single function, or even a set of APIs. The service layer 813 provides software services to the computer 802 or other components (whether or not illustrated) that are communicably coupled to the computer 802. The functionality of the computer 802 may be accessible for all service consumers using this service layer. Software services, such as those provided by the service layer 813, provide reusable, defined functionalities through a defined interface. For example, the interface may be software written in JAVA, C++, or other suitable language providing data in extensible markup language (XML) format or other suitable format. While illustrated as an integrated component of the computer 802, alternative implementations may illustrate the API 812 or the service layer 813 as stand-alone components in relation to other components of the computer 802 or other components (whether or not illustrated) that are communicably coupled to the computer 802. Moreover, any or all parts of the API 812 or the service layer 813 may be implemented as child or sub-modules of another software module, enterprise application, or hardware module without departing from the scope of this disclosure.

The computer 802 includes an interface 804. Although illustrated as a single interface 804 in FIG. 8, two or more interfaces 804 may be used according to particular needs, desires, or particular implementations of the computer 802. The interface 804 is used by the computer 802 for communicating with other systems in a distributed environment that are connected to the network 830 (whether illustrated or not). Generally, the interface 804 comprises logic encoded in software or hardware (or a combination of software and hardware) and operable to communicate with the network 830. More specifically, the interface 804 may comprise software supporting one or more communication protocols associated with communications such that the network 830 or interface's hardware is operable to communicate physical signals within and outside of the illustrated computer 802.

The computer 802 includes a processor 805. Although illustrated as a single processor 805 in FIG. 8, two or more processors may be used according to particular needs, desires, or particular implementations of the computer 802. Generally, the processor 805 executes instructions and manipulates data to perform the operations of the computer 802 and any algorithms, methods, functions, processes, flows, and procedures as described in the instant disclosure.

The computer 802 also includes a database 806 that can hold data for the computer 802 or other components (or a combination of both) that can be connected to the network 830 (whether illustrated or not). For example, database 806 can be an in-memory, conventional, or other type of database storing data consistent with this disclosure. In some implementations, database 806 can be a combination of two or more different database types (for example, a hybrid in-memory and conventional database) according to particular needs, desires, or particular implementations of the computer 802 and the described functionality. Although illustrated as a single database 806 in FIG. 8, two or more databases (of the same or combination of types) can be used according to particular needs, desires, or particular implementations of the computer 802 and the described functionality. While database 806 is illustrated as an integral component of the computer 802, in alternative implementations, database 806 can be external to the computer 802.

The computer 802 also includes a memory 807 that can hold data for the computer 802 or other components (or a combination of both) that can be connected to the network 830 (whether illustrated or not). For example, memory 807 can be random access memory (RAM), read-only memory (ROM), optical, magnetic, and the like storing data consistent with this disclosure. In some implementations, memory 807 can be a combination of two or more different types of memory (for example, a combination of RAM and magnetic storage) according to particular needs, desires, or particular implementations of the computer 802 and the described functionality. Although illustrated as a single memory 807 in FIG. 8, two or more memories 807 (of the same or combination of types) can be used according to particular needs, desires, or particular implementations of the computer 802 and the described functionality. While memory 807 is illustrated as an integral component of the computer 802, in alternative implementations, memory 807 can be external to the computer 802.

The application 808 is an algorithmic software engine providing functionality according to particular needs, desires, or particular implementations of the computer 802, particularly with respect to functionality described in this disclosure. For example, application 808 can serve as one or more components, modules, or applications. Further, although illustrated as a single application 808, the application 808 may be implemented as multiple applications 808 on the computer 802. In addition, although illustrated as integral to the computer 802, in alternative implementations, the application 808 can be external to the computer 802.

The computer 802 also includes a power supply 814. The power supply 814 can include a rechargeable or non-rechargeable battery than can be configured to be either user- or non-user-replaceable. In some implementations, the power supply 814 can include power-conversion or management circuits (including recharging, standby, or other power management functionality). In some implementations, the power-supply 814 can include a power plug to allow the computer 802 to be plugged into a power source (for example, a generator or inverter) to power the computer 802 or to recharge a rechargeable battery.

There may be any number of computers 802 associated with, or external to, a computer system containing computer 802, each computer 802 communicating over network 830. Further, the term "client," "user," and other appropriate terminology may be used interchangeably as appropriate without departing from the scope of this disclosure. Moreover, this disclosure contemplates that many users may use one computer 802, or that one user may use multiple computers 802

Described implementations of the subject matter can include one or more features, alone or in combination.

For example, in a first implementation, a wellbore tool, comprising: a rod comprising a plurality of rod sections, the rod configured to be placed within a wellbore casing of a low-pressure hydrocarbon well; a plurality of sealing elements positioned at a downhole end of the rod, each sealing element of the plurality of sealing elements configured to provide a gas-tight seal between the sealing element and an inner wall of the wellbore casing; and a handle positioned at an uphole end of the rod to provide a hand grip for a user of the wellbore tool.

The foregoing and other described implementations can each optionally include one or more of the following features:

A first feature, combinable with any of the following features, wherein each one of the plurality of sealing elements further comprises: a circular sealing cup with a flat upper portion oriented towards the handle, the circular sealing cup configured to deform and provide the gas-tight seal against the inner wall of the wellbore casing; a support member configured to provide stiffness to the circular sealing cup; an uphole attachment point configured to connect to a rod section or another sealing element; and a downhole attachment point configured to connect to another sealing element or to a plug.

A second feature, combinable with any of the previous or following features, wherein the circular sealing cup comprises rubber or silicon.

A third feature, combinable with any of the previous or following features, wherein the support member is molded to the circular sealing cup.

A fourth feature, combinable with any of the previous or following features, wherein the uphole attachment point and the downhole attachment point each comprise a threaded connection.

A fifth feature, combinable with any of the previous or following features, wherein the wellbore tool is configured to be installed into the wellbore casing by human intervention.

A sixth feature, combinable with any of the previous or following features, wherein the plurality of rod sections are configured to be separable into individual rod sections.

A seventh feature, combinable with any of the previous or following features, wherein each of the plurality of rod sections are interconnected by a threaded connection.

A eighth feature, combinable with any of the previous or following features, wherein the rod is a telescoping rod and the plurality of rod sections are configured to collapse into one another.

A ninth feature, combinable with any of the previous or following features, wherein the handle further comprises a safety line attachment point uphole of the handle, the safety line attachment point configured to be connected to a safety line.

A tenth feature, combinable with any of the previous or following features, wherein the wellbore tool is configured to be used in wellbore casings six inches in diameter or smaller.

In a second implementation, a method, comprising: inserting a wellbore tool including a plurality of sealing elements attached to a downhole end of the wellbore tool into a wellbore casing of a low-pressure hydrocarbon well; sealing the wellbore casing of the low-pressure hydrocarbon well from a topside atmosphere using one or more of the plurality of sealing elements to form a gas-tight seal against the inner surface of the wellbore casing; and supporting, using one or more of the plurality of sealing elements, a static column of a non-flammable/non-combustible fluid.

The foregoing and other described implementations can each optionally include one or more of the following features:

A first feature, combinable with any of the following features, further comprising securing the wellbore tool within the wellbore casing of the low-pressure hydrocarbon well by a safety line.

A second feature, combinable with any of the previous or following features, wherein the non-flammable/non-combustible fluid comprises water.

A third feature, combinable with any of the previous or following features, wherein the wellbore casing has a pressure substantially less than 25.0 pounds per square inch gauge.

A fourth feature, combinable with any of the previous or following features, wherein each one of the plurality of sealing elements further comprises: a circular sealing cup with a flat upper portion oriented in an uphole direction, the sealing cup configured to deform and provide a gas-tight seal against a wall of the wellbore; a support member configured to provide stiffness to the circular sealing cup; an uphole attachment point configured to connect to a rod of the wellbore tool or to another sealing element; and a downhole attachment point configured to connect to another sealing element or to a plug.

A fifth feature, combinable with any of the previous or following features, further comprising deforming the circular sealing cup in response to the wellbore tool entering the wellbore casing.

A sixth feature, combinable with any of the previous or following features, further comprising, repairing the wellbore casing; and removing the wellbore tool from the wellbore casing.

A seventh feature, combinable with any of the previous or following features, wherein removing the wellbore tool from the wellbore casing comprises removing the plurality of sealing elements and the static column of non-flammable/non-combustible fluid from the wellbore casing.

In a third implementation, a wellbore tool, comprising: a rod comprising a plurality of rod sections, the rod configured to be placed within a low-pressure wellbore; a handle positioned at an uphole end of the rod, the handle configured to provide a hand grip for a user of the wellbore tool; and a plurality of sealing elements positioned at a downhole end of the rod, the plurality of sealing elements configured to provide a gas-tight seal between the plurality of sealing elements and a wall of the low-pressure wellbore, each of the plurality of sealing elements comprising: a circular sealing cup with a flat upper surface oriented toward the handle, the circular sealing cup configured to deform and provide the gas-tight seal against the inner wall of the low-pressure wellbore; a support member configured with one or more stiffness elements adjacent to the flat upper surface of the circular sealing cup to provide stiffness to the circular sealing cup; an uphole attachment point configured to connect to the rod or to another sealing element; and a downhole attachment point configured to connect to another sealing element or to a plug.

Some implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Implementations of the subject matter described in this specification can be implemented as one or more computer programs, that is, one or more modules of computer program instructions encoded on a tangible, non-transitory, computer-readable computer-storage medium for execution by, or to control the operation of, data processing apparatus. Alternatively or in addition, the program instructions can be encoded on an artificially generated propagated signal, for example, a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The term "real-time," "real time," "realtime," "real (fast) time (RFT)," "near(ly) real-time (NRT)," "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data may be less than 1 ms, less than 1 sec., or less than 5 secs. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus," "computer," or "electronic computer device" (or equivalent as understood by one of ordinary skill in the art) refer to data processing hardware and encompass all kinds of apparatus, devices, and machines for processing data, including by way of example, a programmable processor, a computer, or multiple processors or computers. The apparatus can also be or further include special purpose logic circuitry, for example, a central processing unit (CPU), an FPGA (field programmable gate array), or an ASIC (application-specific integrated circuit). In some implementations, the data processing apparatus or special purpose logic circuitry (or a combination of the data processing apparatus or special purpose logic circuitry) may be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, IOS, or any other suitable conventional operating system.

A computer program, which may also be referred to or described as a program, software, a software application, a module, a software module, a script, or code can be written in any form of programming language, including compiled or interpreted languages, or declarative or procedural languages, and it can be deployed in any form, including as a stand-alone program or as a module, component, subroutine, or other unit suitable for use in a computing environment. A computer program may, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network. While portions of the programs illustrated in the various figures are shown as individual modules that implement the various features and functionality through various objects, methods, or other processes, the programs may instead include a number of sub-modules, third-party services, components, libraries, and such, as appropriate. Conversely, the features and functionality of various components can be combined into single components as appropriate.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on general or special purpose microprocessors, both, or any other kind of CPU. Generally, a CPU will receive instructions and data from a read-only memory (ROM) or a random access memory (RAM), or both. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable storage device, for example, a universal serial bus (USB) flash drive, to name just a few.

Computer-readable media (transitory or non-transitory, as appropriate) suitable for storing computer program instructions and data include all forms of non-volatile memory, media and memory devices, including by way of example semiconductor memory devices, for example, erasable programmable read-only memory (EPROM), electrically erasable programmable read-only memory (EEPROM), and flash memory devices; magnetic disks, for example, internal hard disks or removable disks; magneto-optical disks; and CD-ROM, DVD+/−R, DVD-RAM, and DVD-ROM disks. The memory may store various objects or data, including caches, classes, frameworks, applications, backup data, jobs, web pages, web page templates, database tables, repositories storing dynamic information, and any other appropriate information including any parameters, variables, algorithms, instructions, rules, constraints, or references thereto. Additionally, the memory may include any other appropriate data, such as logs, policies, security or access data, reporting files, as well as others. The processor and the memory can be supplemented by, or incorporated in, special purpose logic circuitry.

To provide for interaction with a user, implementations of the subject matter described in this specification can be implemented on a computer having a display device, for example, a CRT (cathode ray tube), LCD (liquid crystal display), LED (Light Emitting Diode), or plasma monitor, for displaying information to the user and a keyboard and a pointing device, for example, a mouse, trackball, or trackpad by which the user can provide input to the computer. Input may also be provided to the computer using a touchscreen, such as a tablet computer surface with pressure sensitivity, a multi-touch screen using capacitive or electric sensing, or other type of touchscreen. Other kinds of devices can be used to provide for interaction with a user as well; for example, feedback provided to the user can be any form of sensory feedback, for example, visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

The term "graphical user interface," or "GUI," may be used in the singular or the plural to describe one or more graphical user interfaces and each of the displays of a particular graphical user interface. Therefore, a GUI may represent any graphical user interface, including but not limited to, a web browser, a touch screen, or a command line interface (CLI) that processes information and efficiently presents the information results to the user. In general, a GUI may include a plurality of user interface (UI) elements, some or all associated with a web browser, such as interactive fields, pull-down lists, and buttons. These and other UI elements may be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with this disclosure), all or a portion of the Internet, or any other communication system or systems at one or more locations (or a combination of communication networks). The network may communicate with, for example, Internet Protocol (IP) packets, Frame Relay frames, Asynchronous Transfer Mode (ATM) cells, voice, video, data, or other suitable information (or a combination of communication types) between network addresses.

The computing system can include clients and servers. A client and server are generally remote from each other and typically interact through a communication network. The relationship of client and server arises by virtue of computer programs running on the respective computers and having a client-server relationship to each other.

Some functions or operations described in the disclosure can be performed by a computer. These functions or operations are considered applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

While this specification contains many specific implementation details, these should not be construed as limitations on the scope of any invention or on the scope of what may be claimed, but rather as descriptions of features that may be specific to particular implementations of particular inventions. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously-described features may act in certain combinations and even initially be claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously-described example implementations do not define or constrain this disclosure. Other changes, substitutions, and alterations are also possible without departing from the spirit and scope of this disclosure.

What is claimed:

1. A wellbore tool comprising:

a first rod comprising a first plurality of rod sections, the first rod configured to be placed within a wellbore casing of a low-pressure hydrocarbon well;

a second rod comprising a second plurality of rod sections, the second rod configured to be placed within the wellbore casing of the low-pressure hydrocarbon well, the second rod being parallel to, and a same length as, the first rod; and a plurality of sealing elements positioned at a downhole-end of the first rod and the second rod, each sealing element of the plurality of sealing elements configured to provide a gas-tight seal between the sealing element and an inner wall of the wellbore casing, each of the sealing elements comprising:

a ring-shaped sealing cup perpendicular to the first rod and the second rod, the ring-shaped sealing cup configured to deform and provide the gas-tight seal against the inner wall of the wellbore casing, the ring-shaped sealing cup comprising a radial slice;

a first support member configured to provide stiffness to the ring-shaped sealing cup, the first support member configured to connect to one of the first plurality of rod sections;

a second support member configured to provide a stiffness to the ring-shaped sealing cup, the second support member configured to connect to one of the second plurality of rod sections; and a stiffness member spanning between the first support member and the second support member, the stiffness member coupled to the first support member and the second support member, the stiffness member having a shape of an arc, wherein an opening of the arc is aligned with the radial slice, the stiffness member positioned to abut and provide an interference with the ring-shaped sealing cup along a flat uphole surface of the ring-shaped sealing cup, the stiffness member having a width less than that of the ring-shaped sealing cup.

2. The wellbore tool of claim 1, further comprising:

a first handle positioned at an uphole-end of the first rod to provide a first handgrip for a user of the wellbore tool; and a second handle positioned at an end of the second rod and proximate to the uphole-end of the first rod to provide a second handgrip for the user of the wellbore tool.

3. The wellbore tool of claim 1, wherein the ring-shaped sealing cup comprises rubber or silicon.

4. The wellbore tool of claim 1, further comprising a safety line attachment point at an uphole-end of the first rod or the second rod, the safety line attachment point configured to be connected to a safety line.

5. The wellbore tool of claim 1, wherein the first plurality of rod sections and the second plurality of rod sections are configured to be separable into individual rod sections.

6. The wellbore tool of claim 1, wherein each of first plurality of rod sections and the second plurality of rod sections are interconnected by a threaded connection.

7. The wellbore tool of claim 1, wherein the first rod and the second rod are telescoping rods and the first plurality of rod sections and the second plurality of rod sections are configured to collapse into one another.

8. The wellbore tool of claim 1, wherein at least one of first plurality of rod sections or the second plurality of rod sections is hollow.

9. A wellbore tool comprising:

a first rod comprising a first plurality of rod sections, the first rod configured to be placed within a wellbore casing of a low-pressure hydrocarbon well;

a second rod comprising a second plurality of rod sections, the second rod configured to be placed within the wellbore casing of the low-pressure hydrocarbon well, the second rod being parallel to, and a same length as, the first rod; and a plurality of sealing elements positioned at a downhole-end of the first rod and the second rod, each sealing element of the plurality of sealing elements configured to provide a gas-tight seal between the sealing element and an inner wall of the wellbore casing, each of the sealing elements comprising:

a ring-shaped sealing cup perpendicular to the first rod and the second rod, the ring-shaped sealing cup configured to deform and provide the gas-tight seal against the inner wall of the wellbore casing, the ring-shaped sealing cup comprising a radial slice;

a first support member configured to provide stiffness to the ring-shaped sealing cup, the first support member configured to connect to one of the first plurality of rod sections;

a second support member configured to provide a stiffness to the ring-shaped sealing cup, the second support member configured to connect to one of the second plurality of rod sections; and a stiffness member spanning between the first support member and the second support member, the stiffness member coupled to the first support member and the second support member, the stiffness member having a shape of an arc, wherein an opening of the arc is aligned with the radial slice, the stiffness member positioned to abut and provide an interference with the ring-shaped sealing cup along a flat uphole surface of the ring-shaped sealing cup, the stiffness member having a width less than that of the ring-shaped sealing cup;

a first handle positioned at an uphole-end of the first rod to provide a first handgrip for a user of the wellbore tool;

a second handle positioned at an end of the second rod and proximate to the uphole-end of the first rod to provide a second handgrip for the user of the wellbore tool; and a safety line attachment point at the uphole-end of the first rod or the uphole-end of the second rod, the safety line attachment point configured to be connected to a safety line.

* * * * *